US009660321B2

(12) United States Patent
Trerise

(10) Patent No.: US 9,660,321 B2
(45) Date of Patent: May 23, 2017

(54) METHOD AND SYSTEM FOR A MOBILE APPLICATION (APP) THAT ASSISTS WITH AIMING OR ALIGNING A SATELLITE DISH OR ANTENNA

(71) Applicant: MaxLinear, Inc., Carlsbad, CA (US)

(72) Inventor: Alan Trerise, Las Gatos, CA (US)

(73) Assignee: MAXLINEAR, INC., Carlsbad, CA (US)

( * ) Notice: Subject to any disclaimer, the term of this patent is extended or adjusted under 35 U.S.C. 154(b) by 993 days.

(21) Appl. No.: 13/861,982

(22) Filed: Apr. 12, 2013

(65) Prior Publication Data

US 2013/0271320 A1 Oct. 17, 2013

Related U.S. Application Data

(60) Provisional application No. 61/623,275, filed on Apr. 12, 2012, provisional application No. 61/623,263, filed on Apr. 12, 2012.

(51) Int. Cl.
*H01Q 3/00* (2006.01)
*H01Q 1/12* (2006.01)

(52) U.S. Cl.
CPC ..... *H01Q 1/125* (2013.01); *H01Q 1/1257* (2013.01)

(58) Field of Classification Search
CPC H01Q 3/00; H01Q 3/02; H01Q 1/125; H01Q 1/1257; H01Q 1/32
USPC ..... 342/359
See application file for complete search history.

(56) References Cited

U.S. PATENT DOCUMENTS 8,284,112 B2 * 10/2012 Otto ..... H01Q 3/08 343/757

* cited by examiner

*Primary Examiner* — Harry Liu
(74) *Attorney, Agent, or Firm* — McAndrews, Held & Malloy, Ltd.

(57) ABSTRACT

An app running on a communication device determines a current position of an antenna, which is to be aligned with a transmitter. The app determines a direction in which the antenna should be oriented so that the antenna is aligned with the transmitter when the communication device is placed by the antenna. The app may generate, based on the determined direction, one or more cues to enable alignment of the antenna so that the current position or a newly determined current position of the antenna is aligned with the determined position of the transmitter. The cues may include audible, visual and/or vibration cues. The app may acquire information from one or more sensors, which are located within the communication device and/or integrated within the antenna. The acquired information may be utilized to determine the current position and/or a newly determined current position of the antenna.

14 Claims, 14 Drawing Sheets

METHOD AND SYSTEM FOR A MOBILE APPLICATION (APP) THAT ASSISTS WITH AIMING OR ALIGNING A SATELLITE DISH OR ANTENNA

CROSS-REFERENCE TO RELATED APPLICATIONS/INCORPORATION BY REFERENCE

This application makes reference to, claims priority to, and claims the benefit of:

U.S. Provisional Application Ser. No. 61/623,275, which was filed on Apr. 12, 2012; and U.S. Provisional Patent Application Ser. No. 61/623,263, filed on Apr. 12, 2012.

This application also makes reference to:

U.S. application Ser. No. 13/861,575, which was filed on Apr. 12, 2013

Each of the above referenced applications is hereby incorporated herein by reference in its entirety.

FIELD OF THE INVENTION

Certain embodiments of the invention relate to assistance with installation of a satellite dish or antenna. More specifically, certain embodiments of the invention relate to a method and system for a mobile application (app) that assists with aiming or aligning a satellite dish or antenna.

BACKGROUND OF THE INVENTION

Free-to-air includes a plurality of Satellite channels can be accessed for free without the need for a subscription from a Satellite Service Provider. Most governments broadcast free-to-air as well as a lot of other service providers. There are currently approximately 70 some million free-to-air satellite users around the world—primarily in Europe, Latin America and South America and it's getting more popular in Asia as well.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

A system and/or method is provided for a mobile application (app) that assists with aiming or aligning a satellite dish or antenna, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

DETAILED DESCRIPTION OF THE INVENTION

Certain embodiments of the invention may be found in a method and system for a mobile application (app) that assists with aiming or aligning a satellite dish or antenna. In various embodiments of the invention, an app running on a communication device determines a current position of an antenna, which is to be aligned with a transmitter. The app determines a direction in which the antenna should be oriented so that the antenna is aligned with the transmitter when the communication device is placed on or near the antenna. The app may generate, based on the determined direction, one or more cues to enable alignment of the antenna so that the current position or a newly determined current position of the antenna is aligned with the determined position of the transmitter. The cues may include audible, visual and/or vibration cues. The app may acquire information from one or more sensors, which are located within the communication device and/or integrated within the antenna. The acquired information may be utilized to determine the current position and/or a newly determined current position of the antenna. The sensors may comprise a gyroscope, an accelerometer, a compass and/or an altimeter. The app may be operable to present, on the communication device, a user interface that is operable to receive input from a user of the communication device. The user input may be utilized to determine a location of said transmitter. The interface may comprise a graphical user interface that is operable to display one or more graphical tools that shows the current position, the determined current position and/or an ideal position for the antenna when the antenna is aligned with the transmitter. The app may be operable to determine when the antenna is aligned with the determined position of the transmitter based on one or more signal metrics received from a receiver that receives signals transmitted by the transmitter.

Figure 1A:
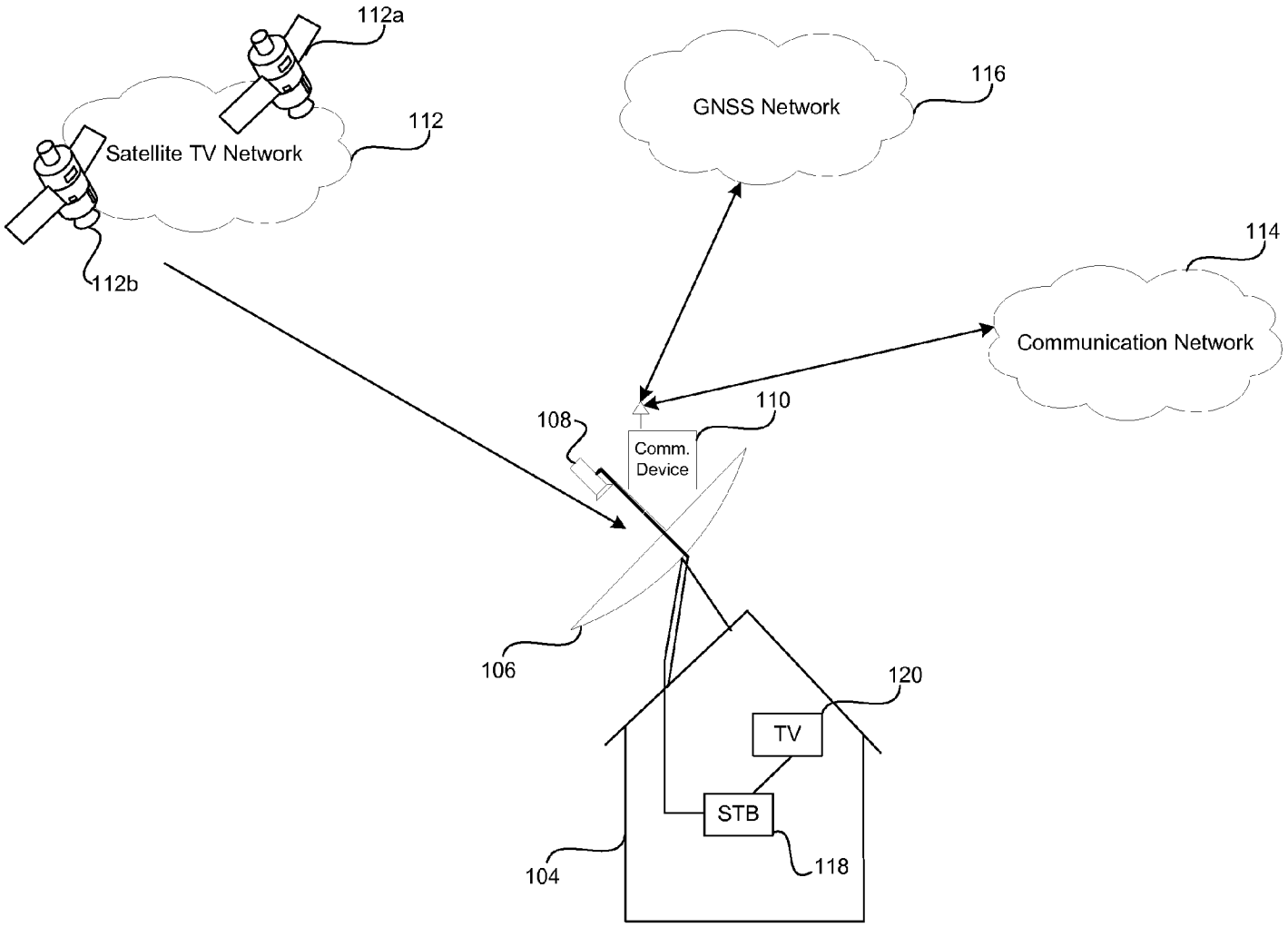
FIG. 1A is a diagram of an exemplary system in which an app running on a communication device may be utilized for aiming or aligning a satellite dish or antenna, in accordance with an embodiment of the invention.

FIG. 1A is a diagram of an exemplary system in which an app running on a communication device may be utilized for aiming or aligning a satellite dish or antenna, in accordance with an embodiment of the invention. Referring to FIG. 1A, there is shown a premises 104, a satellite dish 106, low noise block downconverter (LNB) 108, a communication device 110, a satellite television network 112, a communication network 114 and a global navigation satellite system (GNSS) 116. The premises 104 may comprise a set-top box 118 and a television (TV) 120.

The premises 104 may comprise, for example, a home, a building, an office, and in general, any dwelling.

The satellite dish 106 may comprise suitable logic, circuitry, interfaces and/or code that may be operable to receive and process satellite signals that may be received from a broadcast satellite in the satellite television network 112. For example, the satellite dish 106 may typically comprise the low noise block downconverter 108, which may be utilized to process the received satellite signals. The satellite dish 106 may be placed, for example, on a roof of the premises 104, at a side of the premises 104 or in a window of the premises 104 so long as there is a clear view of the satellite.

The low noise block downconverter (LNB) 108 may comprise suitable logic, circuitry, interfaces and/or code that may be operable to downconvert the satellite signals, which are received from the satellite television network 112. The received satellite signals may be downconverted to generate one or more corresponding intermediate frequency (IF) analog signals, which may be communicated to the set-top box (STB) 118. In this regard, the satellite dish 106 may communicate the one or more corresponding intermediate frequency (IF) analog signals via one or more cables to the set-top box (STB) 118, which is located within the premises 104.

The communication device 110 may comprise suitable logic, circuitry, interfaces and/or code that may be operable to receive and process signals from the communication network 114 and/or the GNSS network 116. The communication device 110 may be operable to receive and process communication signals from the communication network 114. Exemplary signals may comprise 2.5G, 3G, 4G, LTE, WiMax, WiFi, Bluetooth and ZigBee signals. The communication device 110 may be operable to receive and process GNSS signals from a plurality of geosynchronous satellites in the GNSS network 116. In accordance, with an embodiment of the invention, the communication device 110 may be operable to utilize the GNSS signals received from GNSS network 116 and/or the communication signals that are received from the communication network 114 and determine how the satellite dish 106 should be aligned in order to optimize the reception of the satellite signals from the satellite television network 112. The communication device 110 may comprise an antenna alignment application (app), which may be operable to guide a user of the communication device 110 through various steps to align the satellite dish 106. The communication device 110 may comprise a Smartphone, a laptop, a netbook, a tablet, and so on.

The satellite television network 112 may comprise a plurality of satellites and a ground station, which may be referred to as a satellite headend. The satellites in the satellite network are operable to broadcast satellite signals which may be received by the satellite dish 106. The satellite 110*a*, 110*b* may broadcast satellite signals having a frequency in the range of about 950 MHz to 2150 MHz The communication network 114 may comprise suitable devices and/or interfaces that may enable wired and/or wireless communication. In this regard, the communication device 110 may utilize one or more wired and/or wireless protocols to wired and/or wirelessly communicate with the communication network 114. The communication network 114 may comprise, for example, the Internet, a wide area network, a medium area network, a personal area network.

The GNSS network 116 may comprise a plurality of geosynchronous satellites that are utilized to provide positions for terrestrial communication devices. For example, the communication device 110 may be operable to receive and process satellite signals from a plurality of satellites in the satellite television network 112. Based on the processing, the communication device 110 may be operable to determine its position. Exemplary GNSS may comprise GPS, Galileo and GLONASS.

The STB 118 may comprise suitable logic, circuitry, interfaces and/or code that may be operable to handle the processing of the intermediate frequency (IF) analog signals from the low noise block downconverter (LNB) 108. The integrated satellite and terrestrial TV set-top box (STB) 118 may be located in the premises 104. The STB 118 may be operable to demodulate the intermediate frequency (IF) analog signals that are received from the low noise block downconverter (LNB) 108 in order to tune to a particular satellite television channel. Content extracted from the demodulated intermediate frequency (IF) signals may be communicated from the STB 118 to the television 120.

The television (TV) 120 may comprise suitable logic, circuitry, interfaces and/or code that may be operable to receive and display satellite television content from the STB 118. The television 120 may be a television or monitor.

In operation, it may be desirable for a user of the communication device 110 to align the satellite dish with a satellite in the satellite television network 112. The user of the communication device 110 may place the communication device 110 on the satellite dish 106 and run the antenna align app. The communication device may be communicatively coupled to the LNB of the satellite dish 106 via a connector or a cable such as a serial cable. The app running on the communication device 110 may be operable to acquire signal metrics from the LNB. The antenna alignment app running of the communication device 110 may be operable to provide the user of the communication device 110 with guidance on how to orient the satellite dish 106 during the installation. In this regard, the communication device 110 may be operable to receive GNSS signals from the GNSS network and/or communication signals from communication network 114. Based on the information in the communication device 110, and information received from the GNSS signals, the signal metrics from the LNB, and/or the communication signals, the app may determine the location of the premises 104 and the satellite dish 106. Based on the determined location of the premises 104 and the satellite dish 106, the app may determine the satellite to which the satellite dish 106 should be pointed and also the direction in which the satellite dish 106 should be properly oriented or positioned to point at the determined satellite. The app may be operable to provide the user with cues on how the satellite dish 106 should be moved in order to orient or align the satellite dish 106 in the proper position.

The antenna alignment app may be utilized to orient an antenna in other systems without departing from the spirit and scope of the invention. For example, U.S. application Ser. No. 61/623,263, which was filed on Apr. 12, 2012, and U.S. application Ser. No. 13/857,755, which was filed on Apr. 5, 2013, discloses other systems in which an app may be utilized to orient or align an antenna or antenna system without departing from the various embodiments of the invention, and are each hereby incorporated herein by reference in its entirety.

Figure 1B:
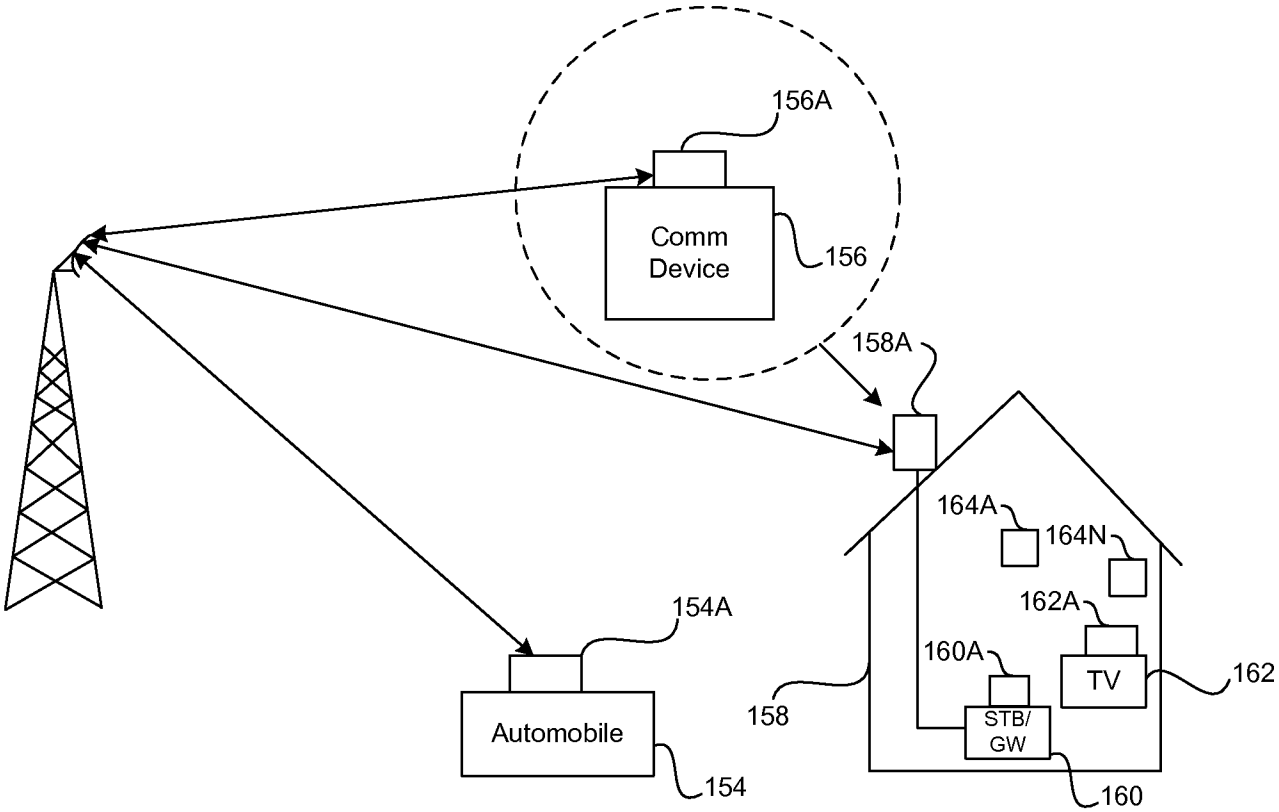
FIG. 1B is a diagram of an exemplary system in which an app running on a communication device may be utilized for aiming or aligning an antenna in a terrestrial system, in accordance with an embodiment of the invention.

FIG. 1B is a diagram of an exemplary system in which an app running on a communication device may be utilized for aiming or aligning an antenna in a terrestrial system, in accordance with an embodiment of the invention. Referring to FIG. 1B, there is shown a terrestrial broadcast tower 152, an automobile 154, a communication device 156 and premises 158. The terrestrial broadcast tower 152 may comprise a broadcast antenna 152*a*. The automobile 154 may comprise an antenna 154*a*. The communication device 156 may comprise an antenna 156*a*, The premises 158 may comprise and antenna 158*a*, a set-top box and/or gateway 158 and a television or monitor 162. The premises 158 may also comprise a distributed millimeter antenna system comprising a plurality of millimeter wave antennas 164A, . . . , 164N.

The terrestrial broadcast tower 152 may comprise an broadcast antenna 152*a*. The terrestrial broadcast tower 152 may be operable to broadcast microwave signals or other signals from the antenna 152.

The automobile 154 may comprise an antenna 154*a*. The antenna 154*a* may comprise, for example, an array antenna. The antenna 154*a* may be operable to receive signals broadcasted from the terrestrial broadcast tower 152 via the broadcast antenna 152*a*. Sensors integrated in the antenna 154*a* may be operable to dynamically configure the antenna 154A as the automobile moves. The antenna 158A may comprise one or more integrated sensors. The sensors may comprise positioning sensors such as, for example, a gyroscope, an accelerometer, and/or a compass. Information from the integrated sensors may be utilized by an antenna alignment app to align the antenna 154*a* when the automobile 154 may be stationary, for example, at a tailgate party. The antenna alignment app may be running on device such as the communication device 156.

The communication device 156 may comprise an antenna 156*a*. The antenna 156*a* may comprise, for example, an array antenna. The antenna 156*a* may be operable to receive signals broadcasted from the terrestrial broadcast tower 152 via the broadcast antenna 152*a*. Sensors integrated in the antenna 156*a* may be operable to dynamically configure the antenna 156A as the automobile moves. The antenna 156A may comprise one or more integrated sensors. The integrated sensors may comprise positioning sensors such as, for example, a gyroscope, an accelerometer, and/or a compass. The communication device 156 may be operable to run or execute an antenna alignment app that may be utilized to align the antennas 160A, 162A and the millimeter wave antennas 164A, 164N in the distributed millimeter antenna system within the premises 158.

The antenna 158*a* at the premises 158 may be operable to receive signals broadcasted from the terrestrial broadcast tower 152 via the broadcast antenna 152*a*. Since the antenna 158*a* is not mounted to a mobile device but is stationary, at installation or realignment, an antenna alignment app running on a communication device may be utilized to align the antenna 158 with the broadcast antenna 152*a*. The antenna 158 may comprise a point-to-point antenna. The antenna 158A may comprise one or more integrated sensors. The integrated sensors may comprise positioning sensors such as, for example, a gyroscope, an accelerometer, and/or a compass.

The set-top box and/or gateway 160 may comprise suitable logic, circuitry, interfaces and/or code that may be operable to demodulate and decode signals that are received the antenna 158*a*. The signals may comprise IF signals, which have been downconverted from RF at the antenna 158. The set-top box and/or gateway 160 may also comprise an antenna 160A. The antenna 160A may comprise an antenna array module, which may be operable to transmit and receive millimeter wave signals such as 60 GHz signals. The antenna 160A may comprise one or more sensors such as a gyroscope, accelerometer and/or a compass. The one or more sensors are operable to determine a position and/or orientation of the antenna 160A.

The television or monitor 162 may be operable to present demodulated and decoded content that is received from the set-top box and/or gateway 160. The television or monitor 162 may also comprise an antenna 162A. The antenna 162A may comprise an antenna array module, which may be operable to transmit and receive millimeter wave signals such as 60 GHz signals. The antenna 162A may comprise one or more sensors such as a gyroscope, accelerometer and/or a compass. The one or more sensors are operable to determine a position and/or orientation of the antenna 162A.

The plurality of millimeter wave antennas 164A, 164N in the distributed millimeter antenna system, in the premises 158, may be operable to receive and/or transmit millimeter wave signals among the plurality of millimeter wave antennas 164A, 164N, the antenna 160A, and/or the antenna 162A. Each of plurality of distributed array antennas 164A, . . . 164N which are located throughout the premises 158 comprise one or more antenna array modules. Exemplary millimeter wave signals may comprise 60 GHz signals. In accordance with an embodiment of the invention, each of the plurality of millimeter wave antennas 164A, 164N in the distributed millimeter antenna system may comprise one or more sensors such as a gyroscope, accelerometer and/or a compass. The one or more sensors are operable to determine a position and/or orientation of the corresponding millimeter wave antenna.

In operation, a user of the communication device 156 may be installing the antenna 158A at the premises 158. The antenna alignment application running on the communication device 156 may be utilized to acquire information from one or more of the sensors that are integrated in the antenna 158A. In some embodiments of the invention, the antenna alignment application may also be operable to acquire signal metric information from the antenna 158A. The signal metric information may correspond to the signals received by the antenna 158A from the broadcast antenna 152A. The acquired information from one or more of the sensors integrated in the antenna 158A and/or the acquired signal metric information from the antenna 158A may be utilized by the antenna alignment app to align the antenna 158A.

A user of the communication device 156 may be installing or configuring the antennas 160A, 162A and the millimeter wave antennas 164A, 164N in the distributed millimeter antenna system at the premises 158. The user may utilize an antenna alignment application running on the communication device 156 to acquire information from one or more of the sensors that are integrated in the antennas 160A, 162A and the millimeter wave antennas 164A, 164N in the distributed millimeter antenna system. In some embodiments of the invention, the antenna alignment application may also be operable to acquire signal metric information from the antennas 160A, 162A and the millimeter wave antennas 164A, 164N in the distributed millimeter antenna system. The signal metric information may correspond to the signals received by a particular one of the antennas 160A, 162A and the millimeter wave antennas 164A, 164N in the distributed millimeter antenna system. The acquired information from one or more of the sensors integrated in the antennas 160A, 162A and the millimeter wave antennas 164A, 164N in the distributed millimeter antenna system and/or the corresponding acquired metrics may be utilized by the antenna alignment app to align the antennas 160A, 162A and the millimeter wave antennas 164A, 164N in the distributed millimeter antenna system.

Figure 1C:
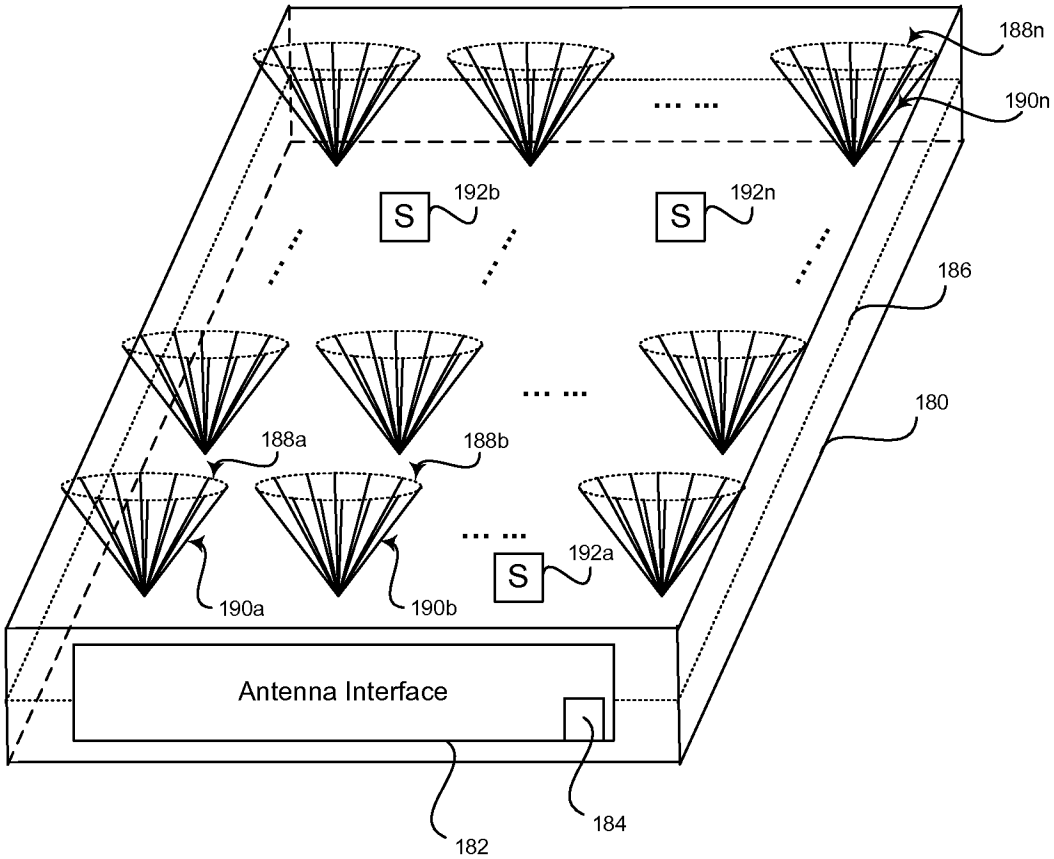
FIG. 1C is a diagram of an exemplary antenna system, which comprises integrated sensors, in which an app running on a communication device may be utilized for aiming or aligning an antenna in a terrestrial system, in accordance with an embodiment of the invention.

FIG. 1C is a diagram of an exemplary antenna system, which comprises integrated sensors, in which an app running on a communication device may be utilized for aiming or aligning an antenna in a terrestrial system, in accordance with an embodiment of the invention. Referring to FIG. 1C, there is shown an antenna array module 180, which may be, for example, a phased antenna array module. The antenna array module 180 may comprise an antenna interface 182, a connector 184, a plurality of array antennas 188*a*, 188*b*, . . . , 188*n*. Each of the plurality of array antennas 188*a*, 188*b*, . . . , 188*n* may comprise a corresponding plurality of array antenna elements 190*a*, 190*b*, . . . , 190*n*. The plurality of array antennas 188*a*, 188*b*, . . . , 188*n* are an exemplary embodiment of a diversity antenna system. An exemplary embodiment of the antennas 154A, 156A, 158A, 160A, 162A, and 164A, . . . , 164N may comprise the antenna array module 180. The antenna array module 180 may also comprise a plurality of sensors 192*a*, 192*b*, . . . , 192*n*.

The plurality of antenna arrays 188*a*, 188*b*, . . . , 188*n* may be integrated on a planar surface such as the substrate 186. The planar surface may also comprise a circuit board or package. In some embodiments of the invention, the plurality of antenna arrays 188*a*, 188*b*, . . . , 188*n* may be integrated on a planar surface to enable the corresponding antenna elements to capture satellite and/or terrestrial signals from one or more directions.

The connector 184 may be operable to couple the antenna array module 180 to other antenna array module, a communication device such as the communication device 156. In various exemplary embodiments of the invention, the connector 184 may comprise a BNC coaxial connector and/or a serial connector. For example, the connector 139 may comprise a thin coaxial connector and/or a serial connector.

The sensors 192*a*, 192*b*, . . . , 192*n* may comprise suitable logic, circuitry, interfaces and/or code that may be operable to determine a position and/or orientation of the antenna array module 180. The sensors 192*a*, 192*b*, . . . , 192*n* may comprise a gyroscope, an accelerometer, a compass and/or an altimeter. Position information from one or more of the sensors 192*a*, 192*b*, . . . , 192*n* may be acquired by and utilized by an antenna alignment app, which may be running on a communication device, to determine the current position and/or a newly determined current position of the antenna array module 180 during alignment of the antenna array module 180.

In some embodiments of the invention, two or more of the antenna array modules 180 may be coupled together via the connector 184. For example, the respective connectors on a plurality of the antenna array module 180 may be utilized to daisy chain or otherwise connect the plurality of the antenna array modules 180.

In an embodiment of the invention, one or more antenna array modules such as the antenna array module 180 may be temporarily placed, for example, on the top of a car or other vehicle at, for example, a tail-gating party and utilized to capture satellite television signals and/or terrestrial signals. In another embodiment of the invention, one or more antenna array modules such as the antenna array module 180 may integrated as an antenna unit, which may be placed on or integrated with the roof of a vehicle and utilized to capture satellite and/or terrestrial signals. In another embodiment of the invention, one or more antenna array modules such as the antenna array module 180 may integrated as an antenna unit, which may be part of a device such as a dish or consumer device.

In accordance with an embodiment of the invention, the antenna elements in the antenna array module 180 may be automatically and/or dynamically configured to optimize reception of satellite signals and/or terrestrial signals. For example, during initial setup of the television, the antenna array module 180 may be configured to optimize reception of the satellite channels and/or terrestrial signals. The antenna elements in the antenna array module 136 may also be dynamically configured to optimize reception of the satellite signals and/or terrestrial signals.

In operation, a user of the communication device 156 may be installing the antenna 158A at the premises 158. The antenna 158A may comprise one or more antenna arrays modules such as the antenna array module 180. The antenna alignment application running on the communication device 156 may be utilized to acquire information from one or more of the sensors 192*a*, 192*b*, . . . , 192*n*, which are integrated in the antenna array module 180 in the antenna 158A. In some embodiments of the invention, the antenna alignment application may also be operable to acquire signal metric information from the antenna array module 180 in the antenna 158A. The signal metric information may correspond to the signals received by the antenna 158A from the broadcast antenna 152A. The acquired information from one or more of the sensors integrated in the antenna array module 180 in the antenna 158A and/or the acquired signal metric information from the antenna array module 180 integrated in the antenna 158A may be utilized by the antenna alignment app to align the antenna 158A.

Figure 2A:
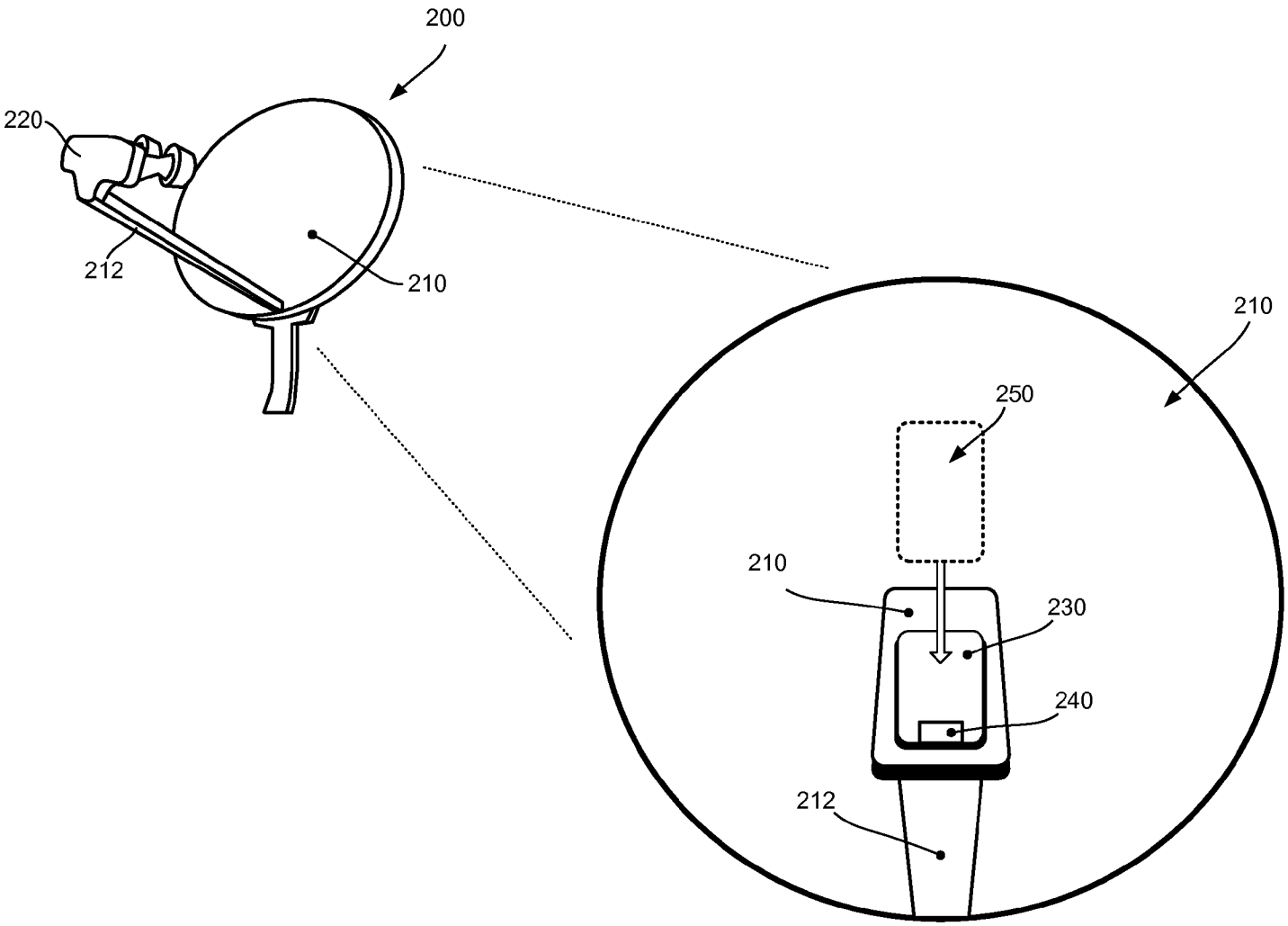
FIG. 2A is a diagram of an exemplary antenna assembly that supports use of an app running on a communication device to align a satellite dish or antenna, in accordance with an embodiment of the invention.

FIG. 2A is a diagram of an exemplary antenna assembly that supports use of an app running on a communication device to align a satellite dish or antenna, in accordance with an embodiment of the invention. Referring to FIG. 2A, there is shown a satellite dish assembly 200 and communication device 250. The satellite dish assembly 200 may comprise a reflector 210, a boom 212, and a low noise block downconverter 220. The low noise block downconverter 220 may comprise a platform 230 and an optional connector 240.

The reflector 210 may be a parabolic reflector that captures and concentrates the satellite signals that are received from the satellite television network 112. The boom 212 supports the low noise block downconverter 220 to the reflector 210 of the satellite dish assembly 200.

The low noise block downconverter 220 may comprise suitable logic, circuitry, interfaces and/or code that may be operable to downconvert the satellite signals, which are received from the satellite television network 112 via the reflector 210. The received satellite signals may be downconverted to generate one or more corresponding intermediate frequency (IF) analog signals, which may be communicated from the low noise block downconverter 220 to the set-top box 118. In this regard, the low noise block downconverter 220 may be operable to communicate the one or more corresponding intermediate frequency (IF) analog signals from the satellite dish assembly 200 to the set-top box 118 via one or more cables, which is located within the premises 104. The low noise block downconverter 220 may be substantially similar to the low noise block downconverter 108, which is shown in and described with respect to FIG. 1A.

The platform 230 may comprise a planar surface that may be operable to support the communication device 250 when it is being utilized to align the satellite dish assembly 200.

The optional connector 240 may comprise a suitable connector or interface that may enable coupling of the communication device 250 to the low noise block downconverter 220. In this regard, the connector may be utilized to power and/or charge the communication device 250 when the communication device 250 is communicatively coupled to the connector 240. The connector 240 may also be operable to communicate various receive satellite signal metrics and/or receive satellite signal data to the communication device 250. Exemplary connector interfaces may comprise universal serial bus and variants thereof. The combination of the connector 240 on the platform 230 may be referred to as a dock. This may enabled to communication device 250 to be docked to the satellite dish assembly 200. Instead of a connector, a cable may be utilized. The cable or connector may allow signal metrics to be communicated from the LNB to the communication device 250. The signal metrics may be utilized by an antenna alignment app to align the antenna.

The communication device 110 may comprise suitable logic, circuitry interfaces and/or code that may be operable to receive and process signals from the communication network 114 and/or the GNSS network 116. The communication device 250 may be substantially similar to the communication device 110. The communication device 250 may also comprise an antenna alignment app that may be operable to communicate with the low noise block downconverter 220 and receive satellite signal metrics and/or satellite signal data. The antenna alignment app may be operable to utilize the received satellite signal metrics and/or satellite signal data to determine a proper alignment of the satellite dish assembly 200. For example, the antenna alignment app may be operable to analyze the received satellite signal metrics and/or satellite signal data to determine when the satellite dish is properly aligned with a particular satellite (112*a* or 112*b*) in the satellite television network 112. The communication device 250 may be placed on the platform 230 and while the communication device 250 is communicatively coupled to the connector 240, the antenna alignment app running on the communication device 250 may determine the current alignment of the satellite dish assembly 200 and based on this current alignment and results of the analysis, the communication device 250 may provide alignment cues to a user of the communication device 250.

In instances when there may be no connector, the antenna alignment app may utilize GNNS signals from the GNSS network 116, communication data from the communication network 114, data from one or more sensors in the communication device 250 and/or data stored on the communication device 250 to determine a proper alignment of the satellite dish assembly 200.

In operation, in accordance with an embodiment of the invention, the antenna alignment app may acquire receive satellite signal metrics and/or satellite signal data and/or data from the low noise block downconverter 220. The antenna alignment app may analyze received satellite signal metrics and/or satellite signal data, data from one or more sensors within the communication device 250, data received from the GNSS network 116, data received from the communication network 114, and/or data stored on the communication device 250 to calculate the proper alignment of the satellite dish assembly 200. Based on results of the analysis, the antenna alignment app may compare the current position of the satellite dish assembly 200 with a calculated ideal position when the satellite dish assembly 200 is aligned and reception of the satellite signals are maximized. The antenna alignment app may determine the current position of the satellite dish assembly 200 based on information received from one or more position sensors within the communication device 250. Based on the difference between the currently determined position of the satellite dish assembly 200 and the calculated ideal position when the satellite dish assembly 200 is aligned and the received satellite signals are at a maximum, the antenna alignment app may generate and present cues to the user of the communication device 250. The cues may inform the user of the communication device 250 the direction in which the satellite dish assembly 200 should be oriented to achieve the calculated ideal position. The data that is received from the communication network 114 by the antenna alignment app may be received from, for example, one or more servers within the communication network 114.

In operation, in accordance with another exemplary embodiment of the invention, in instances when there is no connector 240 for receiving satellite signal metrics and/or satellite signal data from the low noise block downconverter 220, the antenna alignment app may operate in a similar manner without utilizing the satellite signal metrics and/or satellite signal data. In this regard, the antenna alignment app may be operable to analyze data from one or more sensors within the communication device 250, data received from the GNSS network 116, data received from the communication network 114, and/or data stored on the communication device 250 to calculate the proper alignment of the satellite dish assembly 200. Based on results of the analysis, the antenna alignment app may compare the current position of the satellite dish assembly 200 with a calculated ideal position when the satellite dish assembly is aligned with a particular satellite in the satellite television network 112. The antenna alignment app may determine the current position of the satellite dish assembly based on information received from one or more position sensors within the communication device 250. Based on the difference between the currently determined position of the satellite dish assembly and the calculated ideal position when the satellite dish assembly is aligned with the particular satellite, the antenna alignment app may generate and present cues to the user of the communication device 250. The cues may inform the user of the communication device 250 the direction in which the satellite dish assembly 200 should be oriented or moved in order to achieve the calculated ideal position.

Figure 2B:
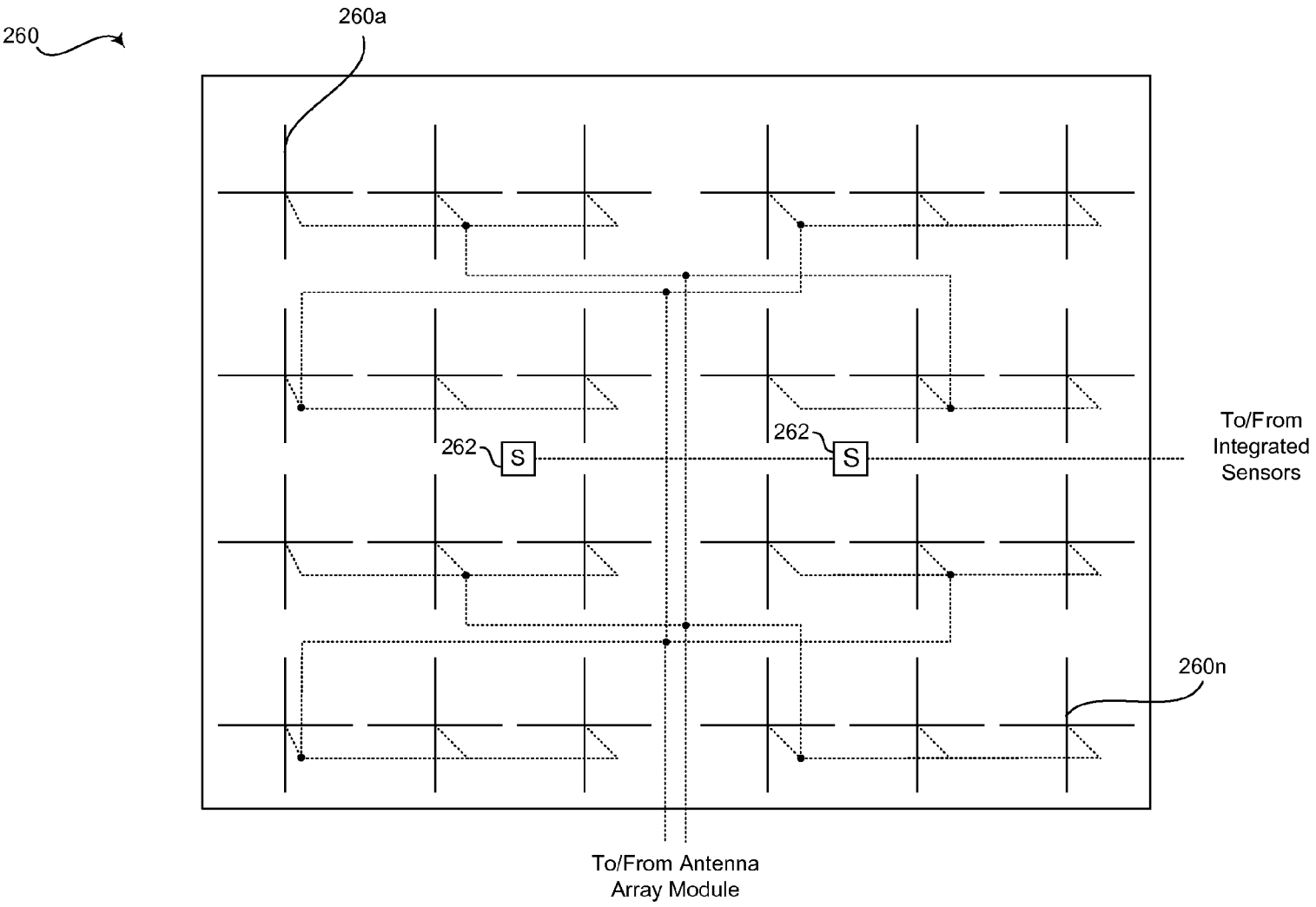
FIG. 2B is a diagram of an exemplary antenna system, which comprises integrated sensors, in which an app running on a communication device may be utilized for aiming or aligning an antenna in a terrestrial system, in accordance with an embodiment of the invention.

FIG. 2B is a diagram of an exemplary antenna system, which comprises integrated sensors, in which an app running on a communication device may be utilized for aiming or aligning an antenna in a terrestrial system, in accordance with an embodiment of the invention. Referring to FIG. 2A, there is shown an antenna 260. The antenna 260 may comprise a plurality of antenna elements 260*a*, . . . , 260*n*.

The antenna 260 may comprise a plurality of sensors 262*a*, . . . , 262*n*. The sensors 262*a*, . . . , 262*n* may comprise suitable logic, circuitry, interfaces and/or code that may be operable to determine a position and/or orientation of the antenna 260. The sensors 262*a*, . . . , 262*n* may comprise a gyroscope, an accelerometer, a compass and/or an altimeter. Position information from one or more of the sensors 262*a*, . . . , 262*n* may be acquired by and utilized by an antenna alignment app, which may be running on a communication device, to determine the current position and/or a newly determined current position of the antenna 260 during alignment of the antenna 158.

Figure 3A:
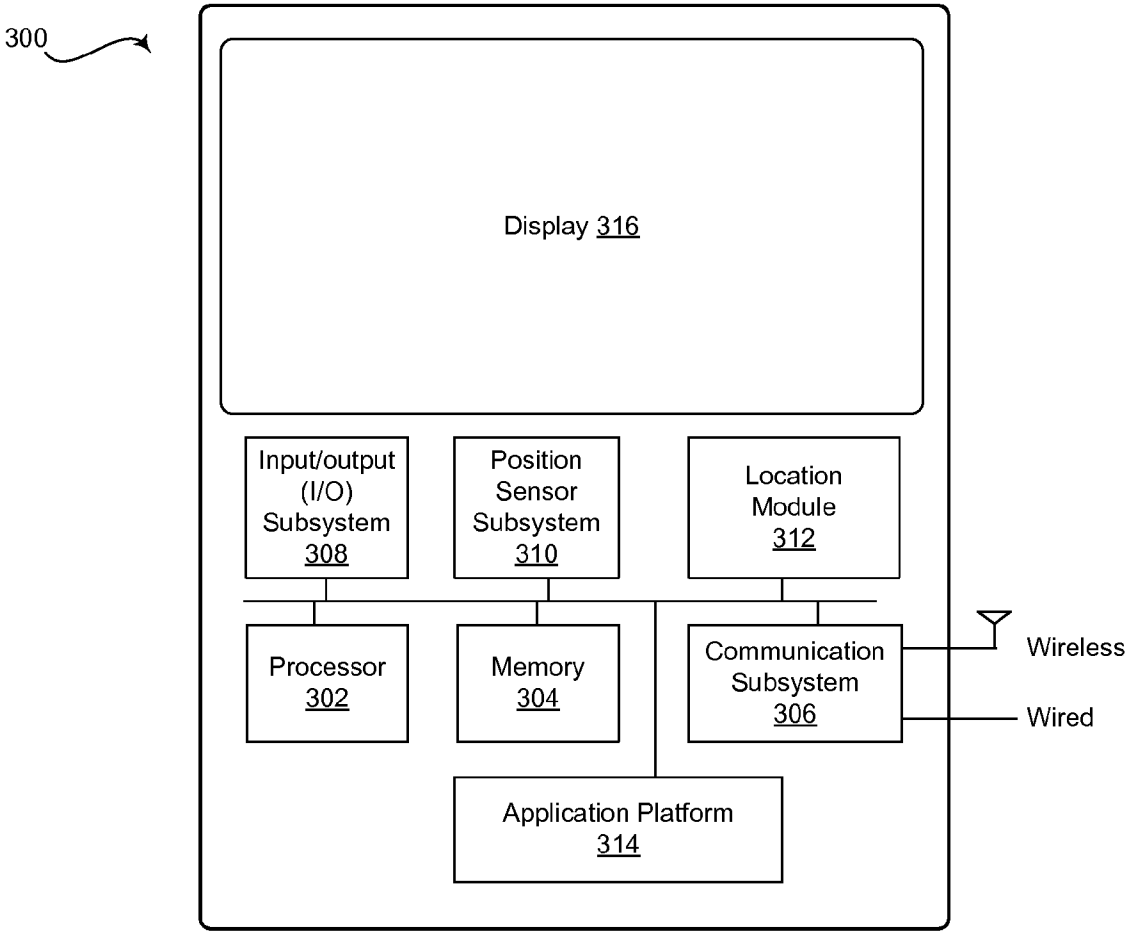
FIG. 3A is a diagram illustrating an exemplary communication device, which may be utilized for aiming or aligning a satellite dish or antenna, in accordance with an implementation of the invention.

FIG. 3A is a diagram illustrating an exemplary communication device, which may be utilized for aiming or aligning a satellite dish or antenna, in accordance with an implementation of the invention. Referring to FIG. 3A, there is shown a communication device 300. The communication device 300 may comprise a processor 302, a memory 304, a communication subsystem 306, an input/output (I/O) subsystem 308, position sensor subsystem 310, a location module 312, an application platform 314 and a display 316.

The processor 302 may comprise suitable, logic, circuitry, interfaces and/or code that may be operable to control operation of the communication device 300. In this regard, the processor 303 may be operable to control operation of the memory 304, the communication subsystem 306, the input/output (I/O) subsystem 308, the location module 312, the application platform 314 and the display 316. The processor 302 may also be operable to execute code for the antenna alignment app that may be running on the communication device 300.

The memory 304 may comprise suitable, logic, circuitry, interfaces and/or code that may be operable to store operating and temporary data for the communication device 300. For example, the memory 304 may be enabled to store configurations and operating data for the communication device 300. The memory 210 may be operable to store OS platform information and data, as well as data utilized by the antenna alignment app to align a satellite dish assemble with a satellite in the satellite television network 112. The memory 304 may also be operable to store satellite location information that may be acquired from the GNSS network 116, the communication network 114 and/or one or more modules within the position sensor subsystem 310.

The communication subsystem 306 may comprise suitable, logic, circuitry, interfaces and/or code that may be operable to communicate utilizing one or more wired and/or wireless technologies. The communication subsystem 306 may comprise one or more transceivers that may be operable to handle wireless and/or wired communication. In an example embodiment of the disclosure, the communication device 300 may communicate wirelessly utilizing various wireless communication technologies for different networks ranging from wireless wide area networks (WWANs), wireless medium area networks (WMANs), wireless local area networks (WLANs), and personal area networks (PANs). Exemplary WWAN technologies comprise 2.5G, 3G, 4G, LTE, and WiMax. Exemplary WLAN technologies comprise 802.11 a/b/g/n/e/ac and so on. Exemplary WPAN technologies comprise Bluetooth and ZigBee signals. Exemplary wired technologies may comprise Ethernet.

The input/output (I/O) subsystem 308 may comprise suitable, logic, circuitry, interfaces and/or code that may be operable to control and/or enable interaction with the communication device 300. The input/output (I/O) subsystem 308 may comprise, for example, a physical keyboard, physical buttons, or a touch-screen-display which may present a software keyboard or buttons. In this regard, the input/output (I/O) subsystem 308 may be utilized to control applications such as the antenna alignment app, which may run on the communication device 300. The input/output (I/O) subsystem 308 may comprise a physical set of keys or buttons, and/or a software generated set of keys that may be utilized to control operation and interfacing with the antenna alignment app. The input/output (I/O) subsystem 308 may also comprise a speaker that may enable audio output. The antenna alignment app may be operable to generate audio and/or visual cues when the satellite dish assembly is being aligned with a satellite in the satellite television network 112.

The input/output (I/O) subsystem 308 may also comprise a speaker, a vibration circuit and/or other devices that may be utilized to provide an alert or cue to a user of the communication device 300. For example, the input/output (I/O) subsystem 308 may be operable to generate an audio alert and/or a vibration alert to aid the user of the communication device 300 with alignment of the satellite dish assembly 200. An antenna alignment app may be utilized to control the I/O subsystem 308 to generate the audio alert and/or the vibration alert.

The position sensor subsystem 310 may comprise suitable, logic, circuitry, interfaces and/or code that may be operable to determine an orientation, position, level and/or direction of the communication device 300. The position sensor subsystem 310 may comprise a plurality of modules, which may be utilized to determine the orientation, the position, the level and/or direction of the communication device 300. FIG. 3C illustrates exemplary modules in the position sensor subsystem 310.

The location module 312 may comprise suitable, logic, circuitry, interfaces and/or code that may be operable to receive GNSS signals from the GNSS network 116. In this regard, the location module 312 may comprise a GPS, Galileo and/or GLONASS receiver that is operable to receive the GNSS signals from the GNSS network 116. The received GNSS signals may be utilized to determine a geographic location of the communication device 300. The geographic location of the communication device 300 may be utilized by the antenna alignment app to, for example, determine the satellite in the satellite television network 112 to which the satellite dish assembly 200 should be aligned. The geographic location of the communication device 300 may be utilized by the antenna alignment app to, for example, calculate the ideal position when the satellite dish assembly is aligned with the particular satellite.

The application platform 314 may comprise suitable, logic, interfaces and/or code that may be operable to control operation of the communication device 300. For example, the application platform 314 may enable a user of the communication device 300 to interact with the communication device 300 via a user interface that is presented on the communication device 300. The application platform 314 may be operable to run or execute applications, and configure settings for the communication device 250. The OS platform 332 may be operable to run the antenna alignment app, which may be utilized to provide alignment cues when aligning an antenna such as the satellite dish assembly 200.

The display 316 may comprise suitable, logic, circuitry, interfaces and/or code that may be operable to display one or more user interfaces that may enable a user of the communication device 300 to interact with the communication device 300. The display 316 may be a touch-screen display that may function as an I/O device. In this regard, the display 316 may be part of the I/O subsystem 308. The display 316 may comprise a software keyboard that may enable a user to provide input to the communication device 300. The display 316 may comprise a user interface to facilitate input and/or user output interaction. In accordance with an embodiment of the invention, an antenna alignment app may be operable to display one or more user interfaces comprising one or more graphical tools that may enable a user of the communication device 300 to align the satellite dish assembly 200.

Figure 3B:
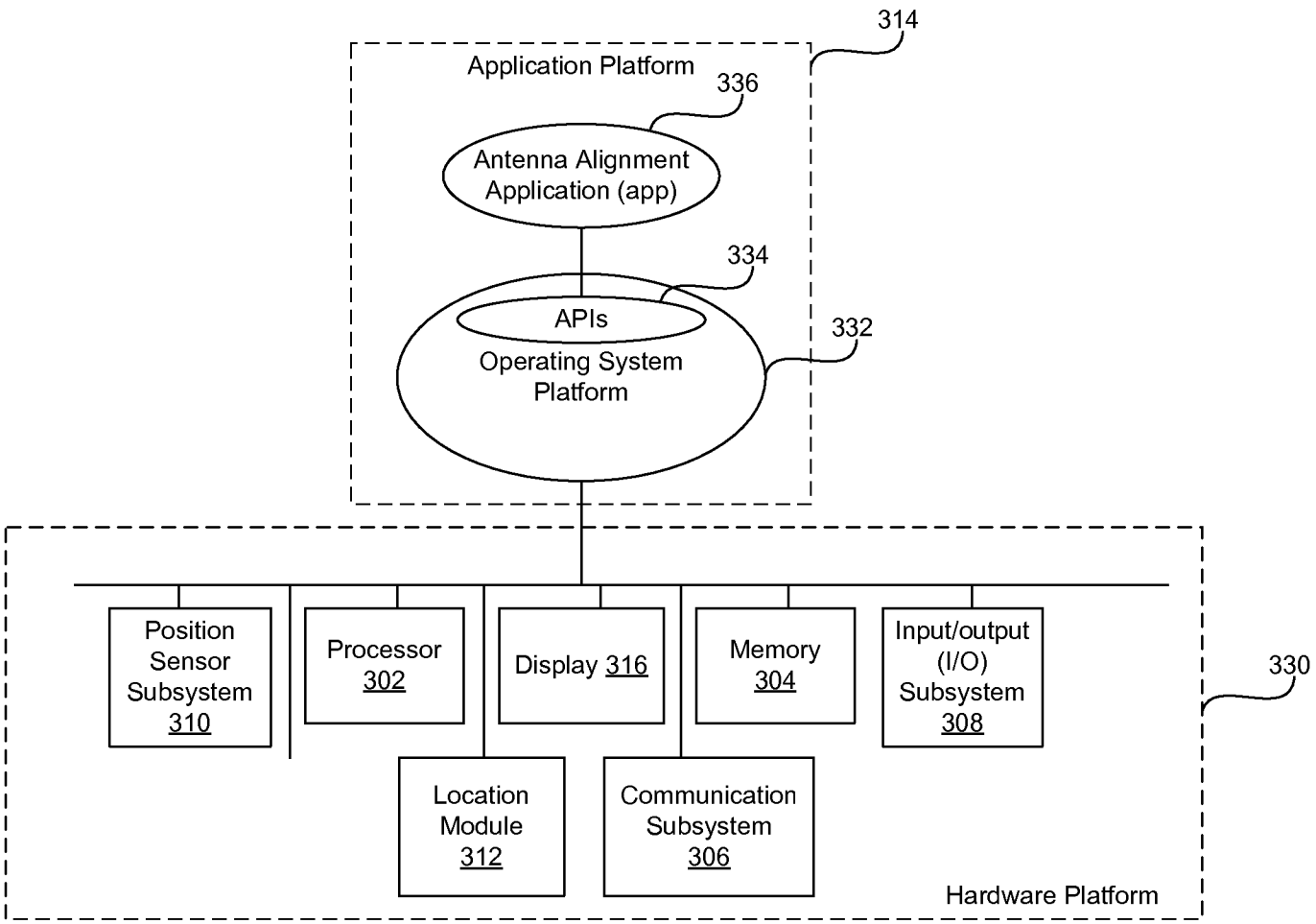
FIG. 3B is a diagram that illustrates an exemplary application platform and hardware platform in a communication device that may be utilized for aiming or aligning a satellite dish or antenna, in accordance with an embodiment of the invention.
Figure 3C:
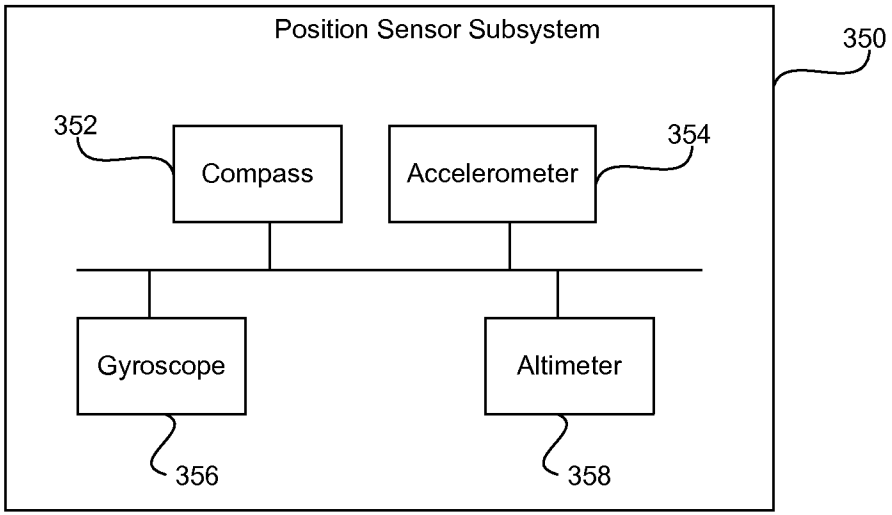
FIG. 3C is a diagram that illustrates an exemplary module in the position sensor subsystem, in accordance with an embodiment of the invention.

FIG. 3B is a diagram that illustrates an exemplary application platform and hardware platform in a communication device that may be utilized for aiming or aligning a satellite dish or antenna, in accordance with an embodiment of the invention. Referring to FIG. 3B, there is shown a hardware platform 330 and an application platform 314. The hardware platform 330 may comprise the processor 302, the memory 304, the communication subsystem 306, the input/output (I/O) subsystem 308, the position sensor subsystem 310, the location module 312 and the display 316. The application platform 314, may comprise an operating system platform 332, application programming interfaces 334, and an antenna alignment application 336.

The processor 302, the memory 304, the communication subsystem 306, the input/output (I/O) subsystem 308, the position sensor subsystem 310, the location module 312 and the display 316 are each substantially similar to the corresponding components that are illustrated and described with respect to FIG. 3A.

The operating system platform 332 may comprise suitable logic, interfaces and/or code that may be operable to control operation of the communication device 300. The operating system platform 332 may be stored in a non-volatile portion of the memory 304. The processor 302 and the memory 304 may be operable to facilitate execution of the code for the operating system platform 332. For example, the operating system platform 332 may enable a user to interact with the communication device 300 and to run or execute applications, and configure settings for the communication device 300. The OS platform 332 may be utilized as an environment to handle execution of the antenna alignment app 336 in the communication device 250.

The application programming interfaces 334 may comprise suitable logic, interfaces and/or code that may be operable to allow applications running on the communication device 300 to interface with the hardware platform 330 via the operating system platform 332. In this regard, the application programming interfaces 334 may enable the applications running on the communication device 300 to access the processor 302, the memory 304, the communication subsystem 306, the input/output (I/O) subsystem 308, the position sensor subsystem 310, the location module 312 and/or the display 316 in order to control their operation and/or acquire information or data. For example, the application programming interfaces 334 may enable the antenna alignment application 336 to acquire position or orientation information for the communication device 300 from one or more sensors in the position sensor subsystem 310. Similarly, the application programming interfaces 334 may enable the antenna alignment application 336 to acquire location information of the communication device 300 from the location module 312. The location information of the communication device 300 and the location information of the satellite dish assembly 200 are assumed to be similar since the communication device 300 and the satellite dish assembly 200 are co-located.

The antenna alignment application 336 may comprise suitable logic, interfaces and/or code that may be operable to assist with alignment of the satellite dish assembly 200 to a satellite in the satellite television network 112. The antenna alignment application 336 runs on the operating system platform 332 and utilizes the application programming interfaces 334 to interface with the operating system platform 332 and also with the components in the hardware platform 330. In this regard, the antenna alignment application 336 is operable to communicate with one or more of the components in the hardware platform 330 to acquire information which may be utilized to determine a current position or orientation of the satellite dish assembly 200 and an identity and location of a satellite to which the satellite dish assembly 200 should be oriented. The antenna alignment application 336 may be operable to communicate with and/or acquire information from the position sensor subsystem 310, the memory 304, the communication subsystem 306, which may be utilized to determine a current position or orientation of the satellite dish assembly 200. The antenna alignment application 336 may be operable to communicate with the location module 312 in order to acquire GNSS location information which may be utilized to determine the location of the satellite dish assembly 200. Based on the determined location of the satellite dish assembly 200, the antenna alignment application 336 may be operable to determine the satellite in the satellite television network 112 to which the satellite dish assembly 200 should be aligned.

In some instances, the location module may be present or may not be able to acquire a location of the GNSS location information of the communication device 300. In this regard, the antenna alignment application 336 may be operable to communicate with the communication subsystem 306 in order to acquire location information from one or more devices in the communication network 114. For example, the antenna alignment application 336 may be operable to communicate with the communication subsystem 306 in order to acquire location information from a nearby cellular base station, an access point and/or router in the communication network 114 or from one or more other devices that may be in the vicinity of the communication device 300. For example, the location information may be acquired from a device within the premises 104.

In operation, the processor 302 may be operable to initiate execution of the antenna alignment application 336 based on input from a user of the communication device 300. In some embodiments of the invention, execution of the antenna alignment application 336 may occur when the communication device 300 is coupled to the connector 240 on the platform 230. The antenna alignment application 336 may be operable to determine the location of the communication device 300 based on information received from one or more of the components in the hardware platform 330. The antenna alignment application 336 may utilize the determined location of the communication device 300 to determine the satellite in the satellite television network 112 to which the satellite dish assembly 200 should be aligned.

In some embodiments of the invention, the antenna alignment application 336 may present a user interface that enables a user of the communication device 300 to enter the address or location of the satellite dish assembly 200. The user interface may be presented on the display 316. Based on the address or location of the satellite dish assembly 200, the antenna alignment application 336 may determine the identity and/or location of the satellite to which the satellite dish assembly 200 should be aligned. This determined location may be referred to as the calculated ideal position.

In some embodiments of the invention, the antenna alignment application 336 may be operable to display a list of satellites and corresponding satellite information or data on the user interface based on GNSS information received from the location module 312 and/or information received from, for example, the memory 304 and/or a server in the communication network 114.

The antenna alignment application 336 may be operable to acquire information from, for example, one or more components in the position sensor subsystem 310. The antenna alignment application 336 may utilize the information acquired from the one or more components in the position sensor subsystem 310 to determine the current position or orientation of the satellite dish assembly 200.

The antenna alignment application 336 may be operable to determine the difference between the calculated ideal position and the current position or orientation of the satellite dish assembly. If there is no difference between the calculated ideal position and the current position or orientation of the satellite dish assembly, then the satellite dish is aligned with the satellite. If there is a difference between the calculated ideal position and the current position or orientation of the satellite dish assembly, then the satellite dish is not aligned with the satellite. In this regard, the antenna alignment application 336 may be operable to determine the position or orientation in which the satellite dish antenna should be placed in order to be aligned with the satellite. The antenna alignment application 336 may be operable to present on the user interface, alignment cues which may enable the user of the communication device 300 to align the satellite dish assembly 200 with the satellite. In various embodiments of the invention, the user interface may display one or more graphical alignment tools that are operable to visually assist the user of the communication device 300 with the alignment. In some embodiments of the invention the antenna alignment application 336 may be operable to present audio and/or vibration cues which may assist the user of the communication device 300 with the alignment. The audio cues may comprise spoken prompts, beeps, tones or other audio tools that may assist the user of the communication device 300 with the alignment. In instances when the antenna alignment application 336 determine the satellite dish assembly is aligned with the satellite, the antenna alignment application 336 may be operable to cause an visual, audio and/or vibration alert to notify the user of the alignment.

In instances when the communication device 300 may be coupled to the low noise block downconverter 220 via the connector 240, the antenna alignment application 336 may be operable to acquire various receive satellite signal metrics and/or receive satellite signal data from the low noise block downconverter 220. The antenna alignment application 336 may be operable to present some of the receive satellite signal metrics and/or receive satellite signal data on the display 316 via the user interface. The antenna alignment application 336 may be operable to utilize the receive satellite signal metrics and/or receive satellite signal data to determine when the satellite dish assembly is aligned with the satellite. For example, the antenna alignment application 336 may utilize the receive signal strength indicator (RSSI), signal to noise ratio (SNR) and/or other signal metrics to determine when the satellite dish assembly 200 is aligned.

FIG. 3C is a diagram that illustrates an exemplary module in the position sensor subsystem, in accordance with an embodiment of the invention. Referring to FIG. 3C, there is shown a position sensor subsystem 350. The position sensor subsystem 350 comprises a compass 352, an accelerometer 354, a gyroscope 356 and an altimeter 358.

The compass 352 may comprise suitable logic, circuitry, interfaces and/or code that may be operable to determine direction. The data from the compass 352 may be utilized by the antenna alignment app 336 to determine the current position and/or orientation of the satellite dish assembly 200

The accelerometer 354 may comprise suitable logic, circuitry, interfaces and/or code that may be operable to determine motion and direction of the communication device 300. The data from the accelerometer 354 may be utilized by the antenna alignment app 336 to determine the current position and/or orientation of the satellite dish assembly 200.

The gyroscope 356 may comprise suitable logic, circuitry, interfaces and/or code that may be operable to determine and measure orientation of the communication device 300. The data from the gyroscope 356 may be utilized by the antenna alignment app 336 to determine the current position and/or orientation of the satellite dish assembly 200.

The altimeter 358 may comprise suitable logic, circuitry, interfaces and/or code that may be operable to determine altitude or height of the communication device 300. The data from the altimeter 358 may be utilized by the antenna alignment app 336 to determine the current position and/or orientation of the satellite dish assembly 200.

In operation, modules in the position sensor subsystem 350 may be operable to determine orientation, position, level and/or direction of the communication device 300. In this regard, the antenna alignment app 336 may be operable to acquire position or orientation information related to position, altitude and/or direction of the communication device 300 from the compass 352, the accelerometer 354, the gyroscope 356 and/or the altimeter 358. The antenna alignment app 336 may be operable to utilize the position or orientation information for the communication device 300 to determine a current alignment of the satellite dish assembly 200. The antenna alignment app 336 may provide alignment cues to a user of the communication device 300, when aligning the satellite dish assembly 200, based on the current alignment of the satellite dish assembly and other information determined by the antenna alignment app 336.

Figure 4A:
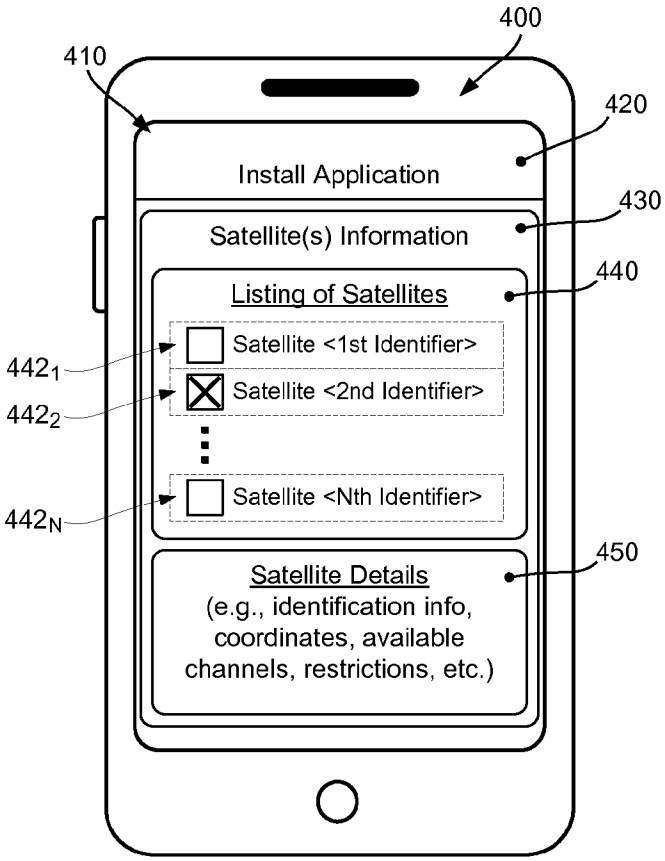
FIG. 4A is a diagram that illustrates an exemplary user interface that may be displayed on a communication device by an antenna alignment app during antenna alignment, in accordance with an embodiment of the invention.

FIG. 4A is a diagram that illustrates an exemplary user interface that may be displayed on a communication device by an antenna alignment app during antenna alignment, in accordance with an embodiment of the invention. Referring to FIG. 4A, there is shown a communication device 400. The communication device 400 may comprise a display 410. The display 410 may present an installation application graphical user interface (GUI) 420. The installation application graphical user interface (GUI) 420 may comprise a satellite information pane 430.

The communication device 400 may be operable to run an antenna alignment application 336 that may be operable to assist a user of the communication device 400 with alignment of the satellite dish assembly 200. The antenna alignment application 336 may be operable to present an installation application graphical user interface 420 on the display 410.

The installation application graphical user interface 420 may comprise a satellite information pane 430, which may be used to display information associated with one or more satellites in the satellite television network 112. The information associated with the one or more satellites may be acquired from one or more of the components in the hardware platform 330, and/or from the communication network 114, for example, a server or other device in the communication network 114. The satellite information pane 430 may comprise a 'listing of satellites' section 440, which may comprise a plurality of satellite identifier fields $\mathbf{442}_1$-$\mathbf{442}_N$, which lists N different identifiers corresponding to N identified satellites, where N is an integer. Each satellite identifier field $\mathbf{442}_i$ may also allow the user to select the corresponding satellite to which the satellite dish assembly 200 should be aimed or aligned. Each satellite identifier field $\mathbf{442}_i$ which may be presented in the installation application graphical user interface 420, may comprise clickable subfield, which may be checked for selecting (and un-checked for deselecting) a corresponding satellite. A user of the communication device 400 may click a button on the satellite information pane 430 to select/de-select the corresponding satellite.

The satellite information pane 430 may also comprise a satellite details section 450. The satellite details section 450 may comprise detailed information for a particular satellite, which may correspond to one of the satellite identifier fields $\mathbf{442}_1$-$\mathbf{442}_N$. For example, the satellite details section 450 may comprise satellite identification information such as satellite name, satellite operator, and/or coordinate information such as orbit and/or position in space. The satellite details section 450 may also comprise content related information such as broadcast sources and/or channels included in the signals, restrictions such as whether content is paid or free, and so on. The satellite details section 450 may be displayed for each satellite when the user accesses the corresponding satellite identifier field, or taps the display above the satellite identifier field. In some instances, each satellite identifier field $\mathbf{442}_i$ may incorporate a sub-field (not shown) for expressly requesting detailed information for a corresponding satellite, with the displaying of the satellite details section 450 being displayed as result of selection of that sub-field.

Figure 4B:
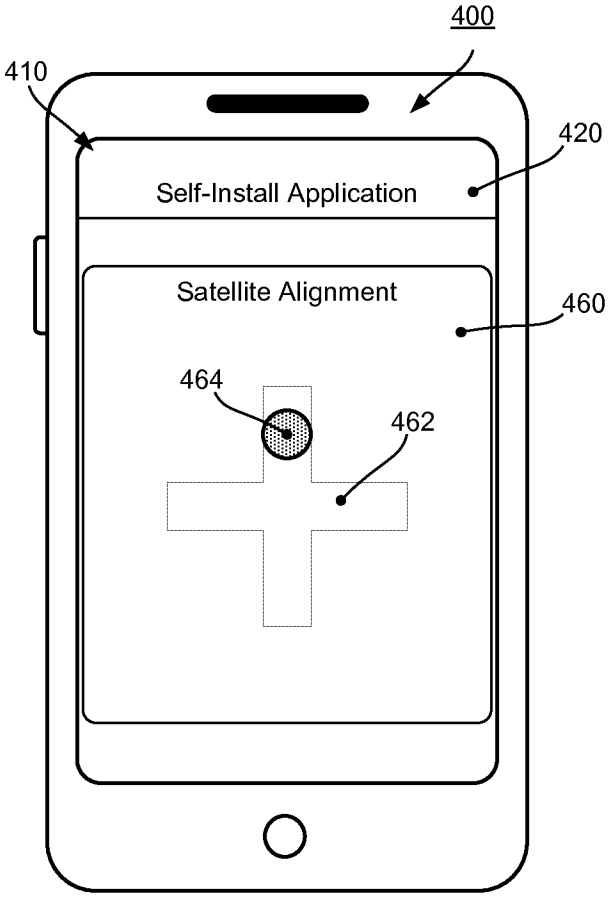
FIG. 4B is a diagram that illustrates an exemplary user interface that may be displayed on a communication device by an antenna alignment app during antenna alignment, in accordance with an embodiment of the invention.

FIG. 4B is a diagram that illustrates an exemplary user interface that may be displayed on a communication device by an antenna alignment app during antenna alignment, in accordance with an embodiment of the invention. Referring to FIG. 4B, there is shown a communication device 400. The communication device 400 may comprise a display 410. The display 410 may present an installation application graphical user interface (GUI) 420. The installation application graphical user interface (GUI) 420 may comprise a satellite alignment pane 460.

The installation application graphical user interface (GUI) 420 may present the satellite alignment pane 460 on the display 410. The satellite alignment pane 460 may comprise a visual cue to assist a user of the communication device with alignment of the satellite dish assembly 200 with a desired or selected satellite. The satellite alignment pane 460 may present a visual cue comprising a level 462 with a bubble 464 to guide a user of the communication device 400 when aligning the satellite dish assembly 200 with a desired or selected satellite. In instances when the bubble 464 is located in the middle of the cross of the level 462, the satellite dish assembly 200 is aligned with the satellite. In instances when the bubble 464 is not located in the middle or intersection of the cross of the level 462, the satellite dish assembly 200 is not aligned with the satellite.

Although a level with a circular bubble is illustrated, the invention in not limited in this regard. Accordingly, other mechanisms such as a plurality of LEDs, or a plurality of bars may be utilized without departing from the spirit and scope of the invention.

Figure 4C:
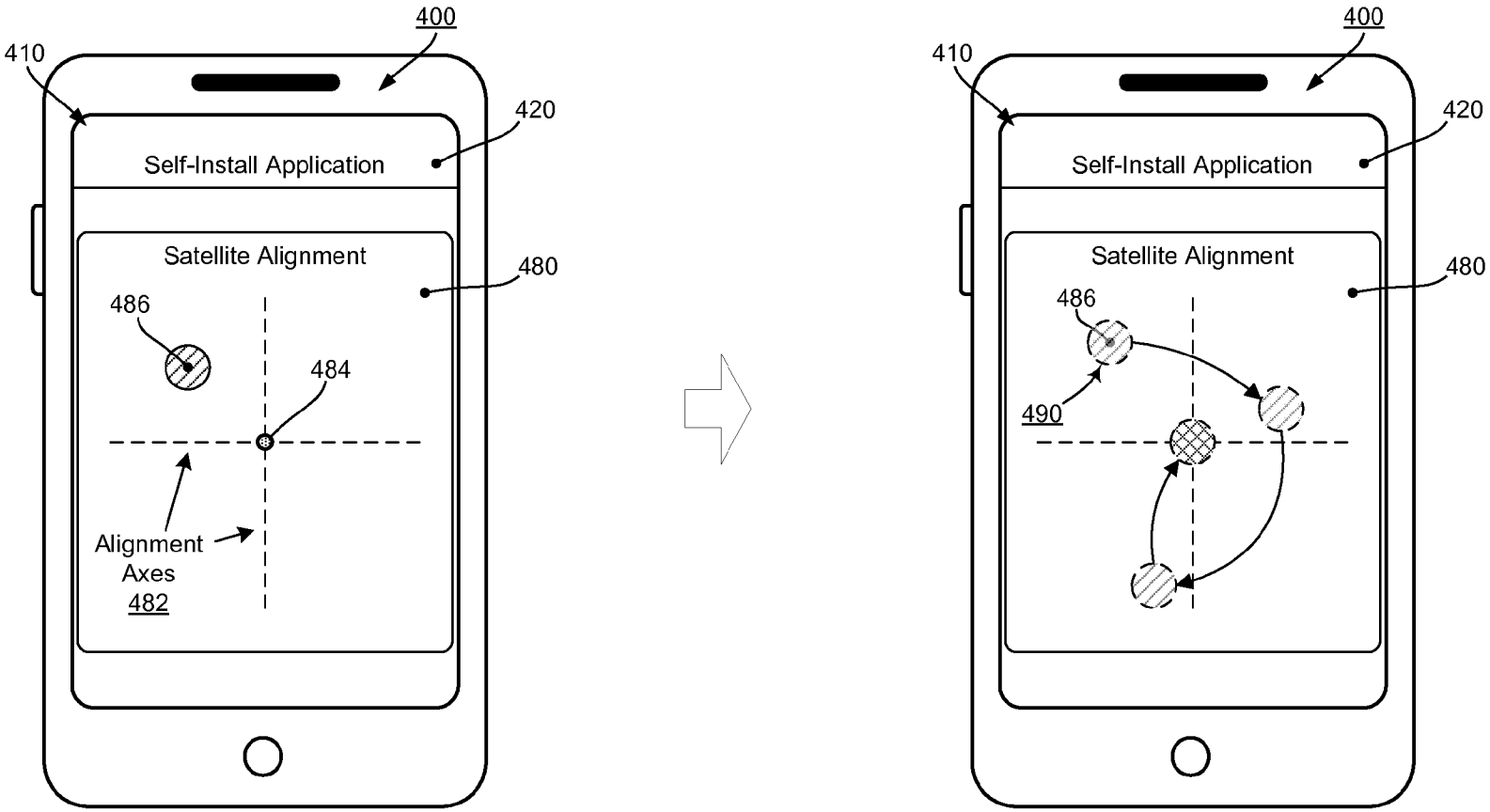
FIG. 4C is a diagram that illustrates an exemplary user interface that may be displayed on a communication device by an antenna alignment app during antenna alignment, in accordance with an embodiment of the invention.

FIG. 4C is a diagram that illustrates an exemplary user interface that may be displayed on a communication device by an antenna alignment app during antenna alignment, in accordance with an embodiment of the invention. Referring to FIG. 4C, there is shown a communication device 400. The communication device 400 may comprise a display 410. The display 410 may present an installation application graphical user interface (GUI) 420. The installation application graphical user interface (GUI) 420 may comprise a satellite alignment pane 480.

The installation application graphical user interface (GUI) 420 may comprise a satellite alignment pane 480, which may comprise a visual and/or graphical interface for assisting a user of the communication device 400 with alignment of an antenna such as the satellite dish assembly 200 to a satellite in the satellite network 112. The satellite alignment pane 480 may be operable to display a current alignment indicator 486, which may indicate the current alignment of the satellite dish assembly 200 relative to a desired alignment position, which may also be referred to as a calculated ideal position. The calculated ideal alignment may be represented in the satellite alignment pane 480 using alignment axes 482, which may comprise two axes (e.g., x and y), such that the intersect point (origin) 484 may correspond to the calculated ideal position. The satellite alignment pane 480 may be operable to provide to the user of the communication device 400 with a dynamic or real-time graphical indication of where the current alignment may be relative to the desired or calculated ideal position.

When the satellite dish assembly 200 is initially installed, its initial alignment may correspond to the position 490, defined by the alignment axes 482, within the satellite alignment pane 480. The user of the communication device 400 may move the satellite dish until the current alignment indicator 486 overlays the intersect point 484.

It should be recognized that the invention is not limited to sensors being located within the communication device 400. Accordingly, in various embodiments of the invention, one or more positions and/or orientation sensors may be integrated within an antenna or antenna system. For example, one or more of the components in the position sensor subsystem 310 may be integrated in the antenna or antenna system. Accordingly, the sensors may be operable to communicate position and/or orientation information to the antenna alignment app 336 in the communication device 400. The antenna alignment app 336 may be operable to provide a user of the communication device 400 with cues for aligning the antenna or antenna system based on information received at least from one or more sensors integrated in the antenna or antenna system. In this regard, the antenna alignment app 336 may be utilized to align, for example, terrestrial broadcast and microwave/millimeter wave point-to-point antennas. The antenna alignment app 336 may also be utilized to align array antennas such as phased array antennas.

Figure 5:
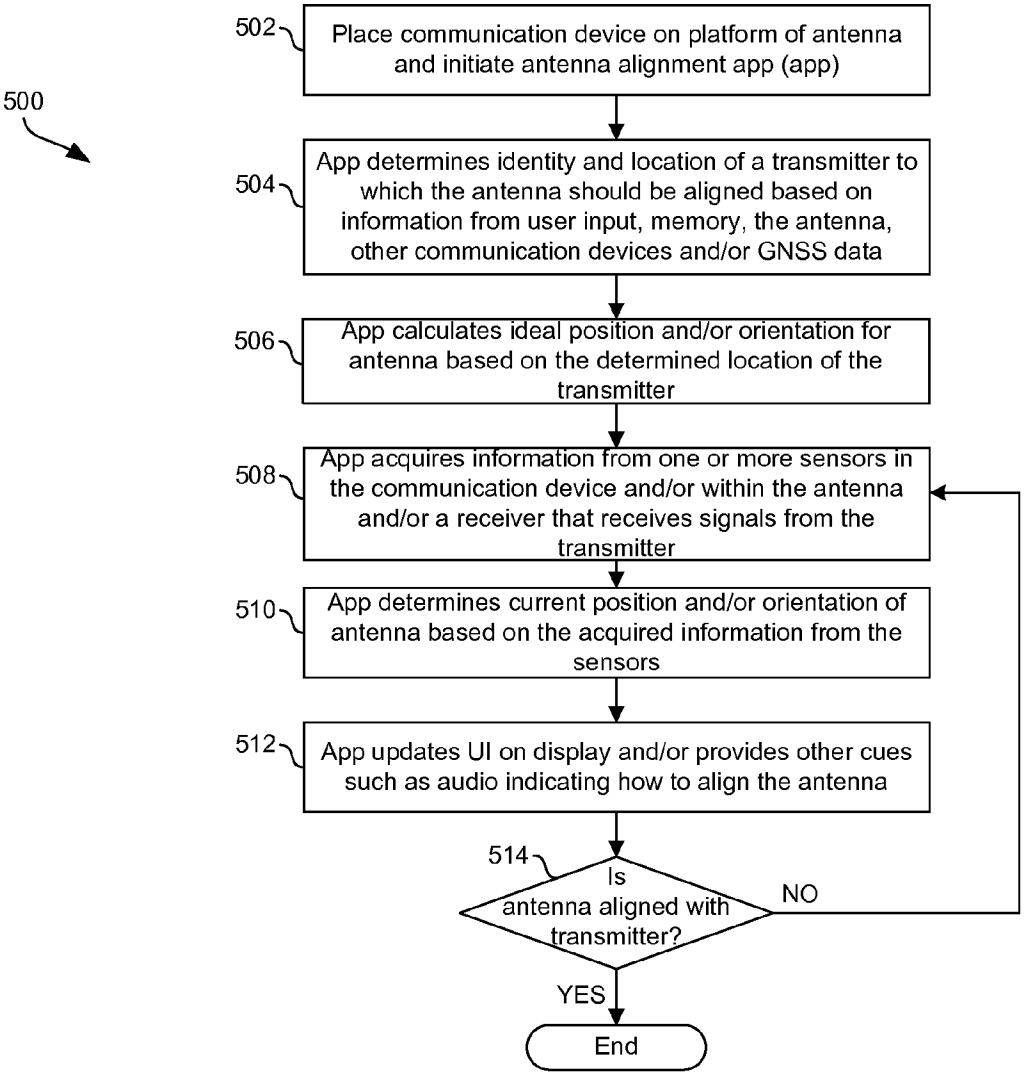
FIG. 5 is a flow chart that illustrates exemplary steps for utilizing an app running on a communication device to assist with alignment of an antenna, in accordance with an implementation of the invention.

FIG. 5 is a flow chart that illustrates exemplary steps for utilizing an app running on a communication device to assist with alignment of an antenna, in accordance with an implementation of the invention. Referring to FIG. 5, there is shown exemplary steps 504 through 514. In step 502, a communication device is placed on a platform of an antenna and an antenna alignment app is initiated. In step 504, the antenna alignment app determines an identity and location of a transmitter to which the antenna should be aligned based on information from user input, memory, the antenna, other communication devices and/or GNSS data. In step 506, the antenna alignment app calculates an ideal position and/or orientation for antenna based on the determined location of the transmitter. In step 508, the antenna alignment app acquires information from one or more sensors in the communication device and/or within the antenna and/or a receiver that receives (eg. satellite dish LNB) signals from the transmitter. In step 510, the antenna alignment app determines a current position and/or orientation of antenna based on the acquired information from the sensors. In step 512, the antenna alignment app updates a user interface on display of the communication device and/or provides other cues such as audio indicating how to align the antenna. In step 514, a determination is made as to whether the antenna is aligned with the transmitter. If in step 514, it is determined that the antenna is aligned with the transmitter, then the exemplary steps end. If in step 514, it is determined that the antenna is not aligned with the transmitter, then the exemplary steps proceed to step 508, where the antenna alignment app acquires information from one or more sensors in the communication device and/or within the antenna. In an exemplary embodiment of the invention, the antenna may comprise the satellite dish assembly 200, the antennas 180, 260, and the transmitter may comprise the satellite 112*a* in the satellite television network 112.

Figure 6:
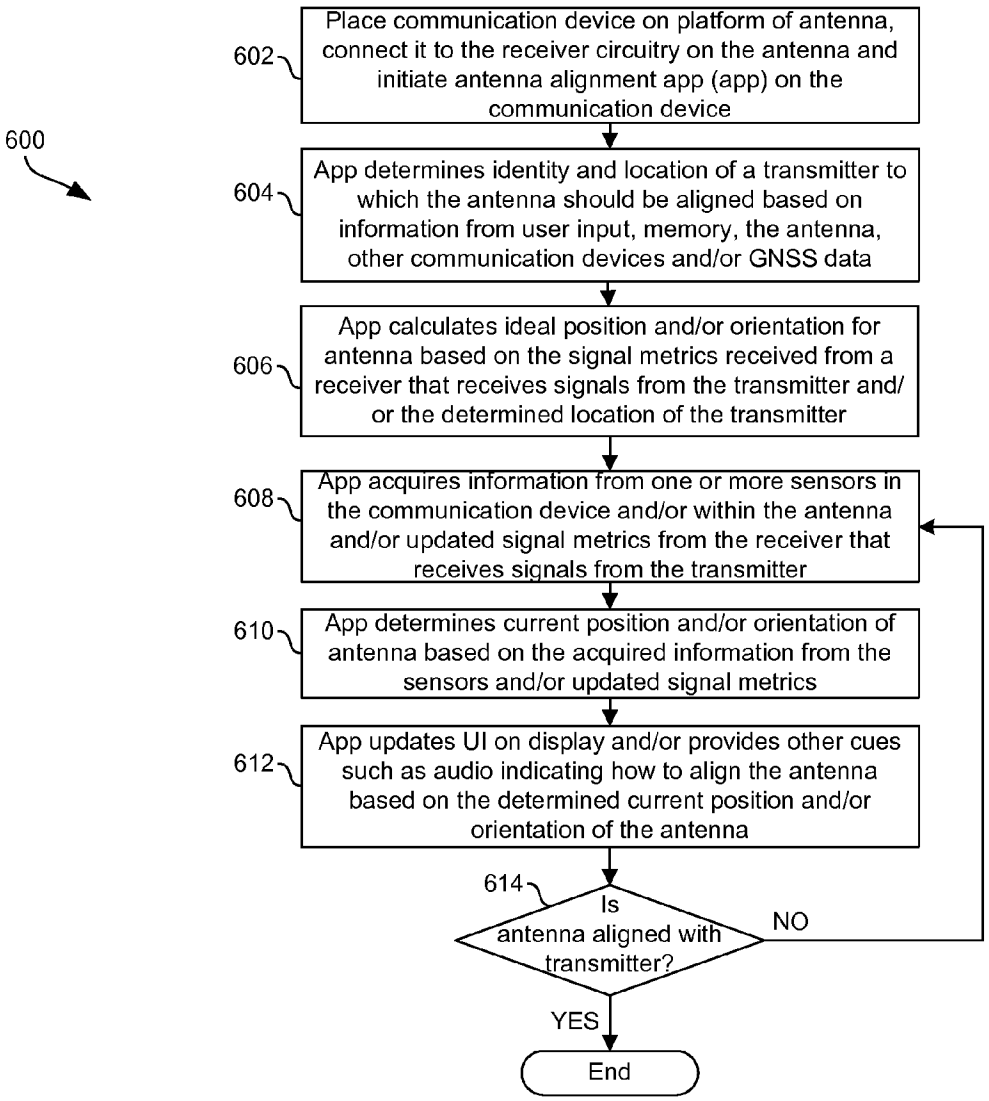
FIG. 6 is a flow chart that illustrates exemplary steps for utilizing an app running on a communication device to assist with alignment of an antenna, in accordance with an implementation of the invention.

FIG. 6 is a flow chart that illustrates exemplary steps for utilizing an app running on a communication device to assist with alignment of an antenna, in accordance with an implementation of the invention. Referring to FIG. 6, there is shown exemplary steps 604 through 614. In step 602, a communication device is placed on a platform of an antenna, connected to receiver circuitry on the antenna and an antenna alignment app is initiated on the communication device. In step 604, the antenna alignment app determines an identity and location of a transmitter to which the antenna should be aligned based on information from user input, memory, the antenna, other communication devices and/or GNSS data. In step 606, the antenna alignment app calculates an ideal position and/or orientation for antenna based on signal metrics received from a receiver that receives signals from the transmitter and/or the determined location of the transmitter. In step 608, the antenna alignment app acquires information from one or more sensors in the communication device and/or within the antenna and/or updated signal metrics from the receiver that receives signals from the transmitter. In step 610, the antenna alignment app determines a current position and/or orientation of the antenna based on the acquired information from the sensors and/or the updated signal metrics. In step 612, the antenna alignment app updates a user interface on display of the communication device and/or provides other cues such as audio indicating how to align the antenna based on the determined current position and/or orientation of the antenna. In step 614, a determination is made as to whether the antenna is aligned with the transmitter. If in step 614, it is determined that the antenna is aligned with the transmitter, then the exemplary steps end. If in step 614, it is determined that the antenna is not aligned with the transmitter, then the exemplary steps proceed to step 608, where the antenna alignment app acquires information from one or more sensors in the communication device and/or within the antenna. In an exemplary embodiment of the invention, the antenna may comprise the satellite dish assembly 200, the antennas 180, 260, the transmitter may comprise the satellite 112*a* in the satellite television network 112 and the receiver circuitry may comprise the low noise block downconverter (LNB) 108.

Figure 7:
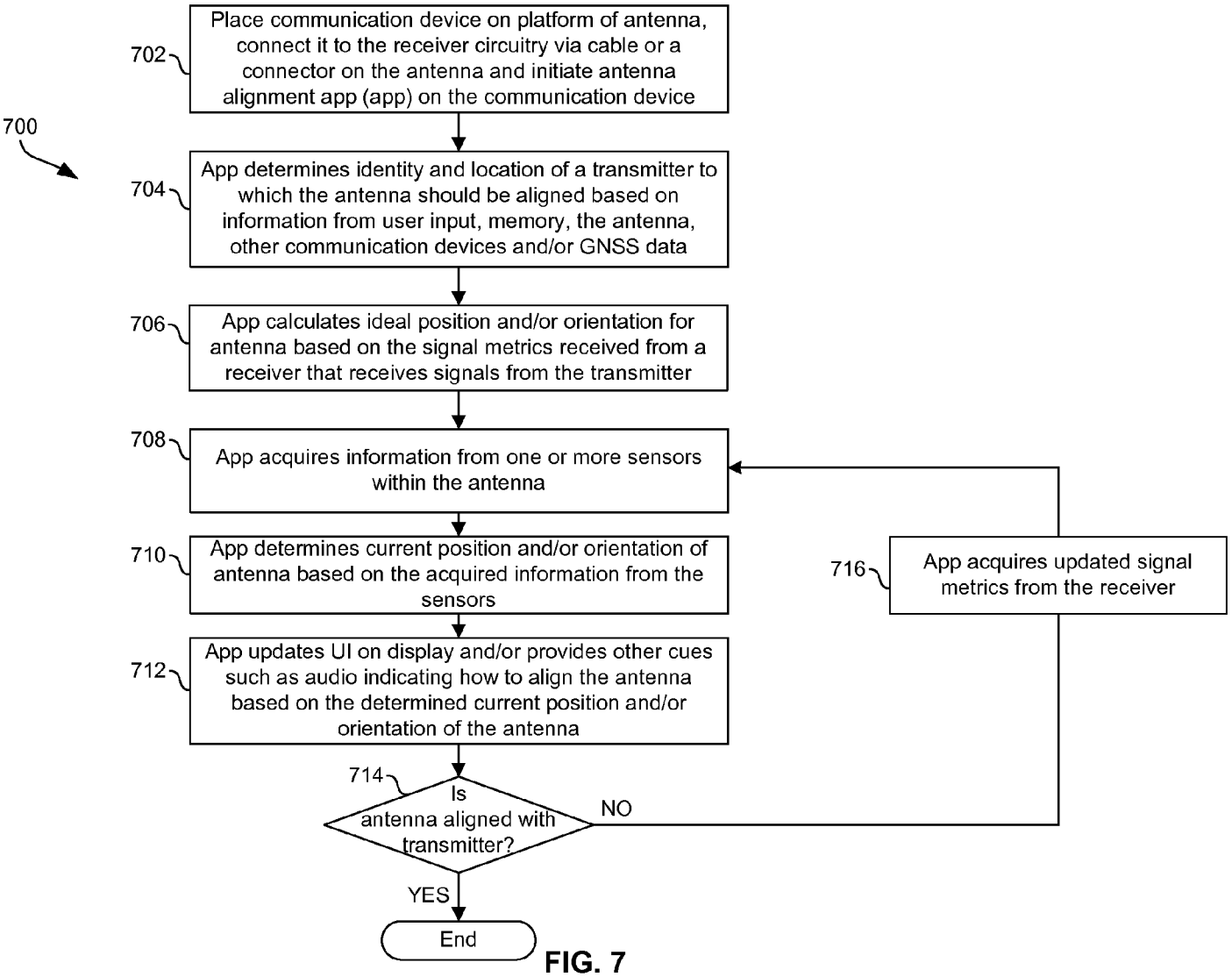
FIG. 7 is a flow chart that illustrates exemplary steps for utilizing an app running on a communication device without sensors to assist with alignment of an antenna, in accordance with an implementation of the invention.

FIG. 7 is a flow chart that illustrates exemplary steps for utilizing an app running on a communication device without sensors to assist with alignment of an antenna, in accordance with an implementation of the invention. Referring to FIG. 7, there is shown exemplary steps 704 through 716. In step 702, a communication device is placed on a platform of an antenna, connected to receiver circuitry on the antenna via a connector or a cable and an antenna alignment app is initiated on the communication device. In step 704, the antenna alignment app determines an identity and location of a transmitter to which the antenna should be aligned based on information from user input, memory, the antenna, other communication devices and/or GNSS data. In step 706, the antenna alignment app calculates an ideal position and/or orientation for antenna based on signal metrics received from a receiver that receives signals from the transmitter. In step 708, the antenna alignment app acquires information from one or more sensors within the antenna. In step 710, the antenna alignment app determines a current position and/or orientation of the antenna based on the acquired information from the sensors. In step 712, the antenna alignment app updates a user interface on display of the communication device and/or provides other cues such as audio indicating how to align the antenna based on the determined current position and/or orientation of the antenna. In step 714, a determination is made as to whether the antenna is aligned with the transmitter. If in step 714, it is determined that the antenna is aligned with the transmitter, then the exemplary steps end. If in step 714, it is determined that the antenna is not aligned with the transmitter, then the exemplary steps proceed to step 716. In step 716, antenna alignment app acquires updated signal metrics from the receiver. Step 708 is executed after step 716. In an exemplary embodiment of the invention, the antenna may comprise the satellite dish assembly 200, the antennas 180, 260, the transmitter may comprise the satellite 112*a* in the satellite television network 112 and the receiver circuitry may comprise the low noise block downconverter (LNB) 108.

In various embodiments of the invention, an app, such as the antenna alignment app 336, running on a communication device 300 may be operable to determine a current position of an antenna such as the satellite dish assembly 200, which is to be aligned with a transmitter such as a satellite 110*b*. The antenna alignment app 336 determines a direction in which the antenna should be oriented so that the antenna is aligned with the transmitter when the communication device is placed by the antenna. The antenna alignment app 336 may generate, based on the determined direction, one or more cues to enable alignment of the antenna so that the current position or a newly determined current position of the antenna is aligned with the determined position of the transmitter. The cues may include audible, visual and/or vibration cues. The antenna alignment app 336 may acquire information from one or more sensors, which are located within the communication device 300 and/or integrated within the antenna. The acquired information may be utilized to determine the current position and/or a newly determined current position of the antenna. The sensors may include a gyroscope 356, an accelerometer 354, a compass 352 and/or an altimeter 358. The antenna alignment app 336 may be operable to present, on the communication device 300, a user interface that is operable to receive input from a user of the communication device 300. The user input may be utilized to determine a location of said transmitter. The interface may comprise a graphical user interface that is operable to display one or more graphical tools that shows the current position, the determined current position and/or an ideal position for the antenna when the antenna is aligned with the transmitter. The antenna alignment app 336 may be operable to determine when the antenna is aligned with the determined position of the transmitter based on one or more signal metrics received from a receiver that receives signals transmitted by the transmitter.

As utilized herein the terms "circuits" and "circuitry" refer to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g.," and "for example" set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled, or not enabled, by some user-configurable setting.

Other embodiments of the invention may provide a computer readable device and/or a non-transitory computer readable medium, and/or a machine readable device and/or a non-transitory machine readable medium, having stored thereon, a machine code and/or a computer program having at least one code section executable by a machine and/or a computer, thereby causing the machine and/or computer to perform the steps as described herein for mobile application (app) that assists with aiming or aligning a satellite dish or antenna.

Accordingly, the present invention may be realized in hardware, software, or a combination of hardware and software. The present invention may be realized in a centralized fashion in at least one computer system, or in a distributed fashion where different elements are spread across several interconnected computer systems. Any kind of computer system or other apparatus adapted for carrying out the methods described herein is suited. A typical combination of hardware and software may be a general-purpose computer system with a computer program that, when being loaded and executed, controls the computer system such that it carries out the methods described herein.

The present invention may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A method, comprising:

in a communication device, when said communication device is located by an antenna:

determining a current location of said communication device;

determining based on said current location of said communication device, a transmitter with which said antenna should be aligned for receiving signals from said transmitter;

determining a current position of said antenna;

determining, based on said current position of said antenna and location of said transmitter, a direction in which said antenna should be oriented so that said antenna is aligned with said transmitter for maximizing reception of signals from said transmitter;

generating based on said determined direction, one or more cues for presenting to a user of said communication device to enable alignment of said antenna with said transmitter in said determined direction, wherein said one or more cues enable said user of said communication device to make adjustments to position or orientation of said antenna, based on said current position or a newly determined current position of said antenna; and presenting on said communication device, a user interface that is operable to receive input from said user of said communication device, wherein:

said input is utilized to determine a location of said transmitter, and said user interface comprises a graphical user interface that is operable to display one or more graphical tools that show said current position, said newly determined current position, and/or an ideal position for said antenna when said antenna is aligned with said transmitter.

2. The method according to claim 1, wherein said one or more cues comprise audible cues, visual cues and/or vibration cues.

3. The method according to claim 1, comprising acquiring information from one or more sensors, which are located within said communication device and/or integrated within said antenna, wherein said acquired information is utilized to determine said current position and/or a newly determined current position of said antenna.

4. The method according to claim 3, wherein said one or more sensors comprise a gyroscope, an accelerometer, a compass and an altimeter.

5. The method according to claim 1, comprising determining when said antenna is aligned with said transmitter based on one or more signal metrics received from a receiver that receives signals transmitted by said transmitter.

6. A system, comprising:

one or more processors for use in a communication device, said one or more processors being operable to, when said communication device is located by an antenna:

determine a current location of said communication device;

determine based on said current location of said communication device, a transmitter with which said antenna should be aligned for receiving signals from said transmitter;

determine a current position of said antenna;

determine, based on said current position of said antenna and location of said transmitter, a direction in which said antenna should be oriented so that said antenna is aligned with said transmitter for maximizing reception of signals from said transmitter;

generate based on said determined direction, one or more cues for presenting to a user of said communication device to enable alignment of said antenna with said transmitter in said determined direction, wherein said one or more cues enable said user of said communication device to make adjustments to position or orientation of said antenna, based on said current position or a newly determined current position of said antenna; and present on said communication device, a user interface that is operable to receive input from said user of said communication device, wherein:

said input is utilized to determine a location of said transmitter, and said user interface comprises a graphical user interface that is operable to display one or more graphical tools that show said current position, said newly determined current position, and/or an ideal position for said antenna when said antenna is aligned with said transmitter.

7. The system according to claim 6, wherein said one or more cues comprise audible cues, visual cues and/or vibration cues.

8. The system according to claim 6, wherein said one or more processors are operable to acquire information from one or more sensors, which are located within said communication device and/or integrated within said antenna, wherein said acquired information is utilized to determine said current position and/or a newly determined current position of said antenna.

9. The system according to claim 8, wherein said one or more sensors comprise a gyroscope, an accelerometer, a compass and an altimeter.

10. The system according to claim 6, wherein said one or more processors are operable to determine when said antenna is aligned with said transmitter based on one or more signal metrics received from a receiver that receives signals transmitted by said transmitter.

11. A computer readable device having stored thereon, a computer program having at least one code section, the at least one code section being executable by a communication device for causing said communication device to perform steps comprising, when said communication device is located by an antenna:

determining a current location of said communication device;

determining based on said current location of said communication device, a transmitter with which said antenna should be aligned for receiving signals from said transmitter;

determining a current position of said antenna;

determining, based on said current position of said antenna and location of said transmitter, a direction in which said antenna should be oriented so that said antenna is aligned with said transmitter for maximizing reception of signals from said transmitter;

generating based on said determined direction, one or more cues for presenting to a user of said communication device to enable alignment of said antenna with said transmitter in said determined direction, wherein said one or more cues enable said user of said communication device to make adjustments to position or orientation of said antenna, based on said current position or a newly determined current position of said antenna; and presenting on said communication device, a user interface that is operable to receive input from said user of said communication device, wherein:

said input is utilized to determine a location of said transmitter, and said user interface comprises a graphical user interface that is operable to display one or more graphical tools that show said current position, said newly determined current position, and/or an ideal position for said antenna when said antenna is aligned with said transmitter.

12. The computer readable device according to claim 11, wherein said one or more cues comprise audible cues, visual cues and/or vibration cues.

13. The computer readable device according to claim 11, wherein:

said at least one code section is operable to acquire information from one or more sensors, which are located within said communication device and/or integrated within said antenna, wherein said acquired information is utilized to determine said current position and/or a newly determined current position of said antenna; and said one or more sensors comprise a gyroscope, an accelerometer, a compass and an altimeter.

14. The computer readable device according to claim 11, wherein said at least one code section is operable to determine when said antenna is aligned with said transmitter based on one or more signal metrics received from a receiver that receives signals transmitted by said transmitter.

* * * * *